US008806859B2

(12) United States Patent
Komitsu et al.

(10) Patent No.: US 8,806,859 B2
(45) Date of Patent: Aug. 19, 2014

(54) EXHAUST GAS APPARATUS OF AN INTERNAL COMBUSTION ENGINE

(75) Inventors: Hideyuki Komitsu, Toyota (JP); Nakaya Takagaki, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/387,814

(22) PCT Filed: Aug. 28, 2009

(86) PCT No.: PCT/JP2009/004224

§ 371 (c)(1), (2), (4) Date: Jan. 30, 2012

(87) PCT Pub. No.: WO2011/024231

PCT Pub. Date: Mar. 3, 2011

(65) Prior Publication Data

US 2012/0137666 A1 Jun. 7, 2012

(51) Int. Cl.
*F01N 1/00* (2006.01)

(52) U.S. Cl.
USPC ..... 60/324; 60/322; 181/227; 181/228

(58) Field of Classification Search
USPC ..... 60/274–324
See application file for complete search history.

(56) References Cited

U.S. PATENT DOCUMENTS 2,882,993 A * 4/1959 Murty ..... 181/281
2,887,033 A * 5/1959 Wachter, Jr. ..... 454/2
3,009,529 A * 11/1961 Brown ..... 181/264
3,262,516 A * 7/1966 Borgeson ..... 181/268
3,576,232 A 4/1971 Lebert
4,235,304 A * 11/1980 Suyama ..... 181/265
4,301,652 A * 11/1981 Sohda et al. ..... 60/310
5,371,331 A * 12/1994 Wall ..... 181/227

(Continued)

FOREIGN PATENT DOCUMENTS

JP Y1-49-010658 3/1974
JP A-57-059916 9/1982

(Continued)

OTHER PUBLICATIONS

International Search Report issued in Application No. PCT/JP2009/004224; Dated Nov. 24, 2009 (With Translation).

(Continued)

*Primary Examiner* — Jesse Bogue
(74) *Attorney, Agent, or Firm* — Oliff PLC

(57) ABSTRACT

An exhaust gas apparatus suppresses sound pressure level from increasing, and reducing its weight and production cost without need of a sub-muffler in a tail pipe and a sound deadening device having an air column resonance of a large capacity provided at the upstream opened end of the tail pipe. The exhaust gas apparatus is provided with an exhaust gas pipe, an upstream opened end connected to the sound deadening device positioned at the upstream side of an exhaust gas discharging direction, and a downstream opened end through which the exhaust gas is discharged to the atmosphere. A plate is provided at least one of the upstream opened end and the downstream opened end in opposing relationship with the exhaust gas discharging direction, and formed with an opened portion. The exhaust gas pipe is formed at its peripheral wall axially inwardly spaced apart from the plate with a through bore.

4 Claims, 20 Drawing Sheets

(56) References Cited

U.S. PATENT DOCUMENTS

| | | | | | |
|---|---|---|---|---|---|
| 5,831,223 | A | * | 11/1998 | Kesselring | 181/227 |
| 5,934,959 | A | * | 8/1999 | Inman et al. | 440/89 R |
| 6,006,859 | A | * | 12/1999 | Hussaini | 181/227 |
| 6,810,992 | B1 | * | 11/2004 | Lombardo | 181/227 |
| 7,086,498 | B2 | * | 8/2006 | Choi et al. | 181/270 |
| 7,566,355 | B2 | * | 7/2009 | Gaskins | 55/385.4 |
| 7,779,961 | B2 | * | 8/2010 | Matte | 181/227 |
| 8,550,208 | B1 | * | 10/2013 | Potokar | 181/212 |

FOREIGN PATENT DOCUMENTS

| | | |
|---|---|---|
| JP | U-57-059916 | 9/1982 |
| JP | U-03-071120 | 7/1991 |
| JP | A-08-035415 | 2/1996 |
| JP | A-2002-089230 | 3/2002 |
| JP | A-2003-129821 | 5/2003 |
| JP | A-2003-206738 | 7/2003 |
| JP | A-2004-360618 | 12/2004 |
| JP | A-2005-069189 | 3/2005 |
| JP | A-2006-046121 | 2/2006 |

OTHER PUBLICATIONS

International Search Report issued in Application No. PCT/JP2009/004224 dated Nov. 24, 2009 (With Translation).

* cited by examiner

EXHAUST GAS APPARATUS OF AN INTERNAL COMBUSTION ENGINE

TECHNICAL FIELD

This invention relates to an exhaust gas apparatus of an internal combustion engine, and in particularly to an exhaust gas apparatus of an internal combustion engine for suppressing the increase of a sound pressure caused by an air column resonance of a tail pipe provided at the most downstream side in the discharging direction of an exhaust gas.

BACKGROUND ART

As an exhaust gas apparatus of an internal combustion engine to be used by an automotive vehicle, there is known an exhaust gas apparatus as shown in FIG. 19 (for example Patent Document 1). In FIG. 19, the known exhaust gas apparatus 4 is adapted to allow an exhaust gas to be introduced therein after the exhaust gas exhausted from an engine 1 serving as an internal combustion engine passes through an exhaust manifold 2 and is purified by a catalytic converter 3.

The exhaust gas apparatus 4 is constituted by a front pipe 5 connected to the catalytic converter 3, a center pipe 6 connected to the front pipe 5, a main muffler 7 connected to the center pipe 6 and serving as a sound deadening device, a tail pipe 8 connected to the main muffler 7, and a sub-muffler 9 connected to the tail pipe 8.

As shown in FIG. 20, the main muffler 7 has an expansion chamber 7*a* for expanding and introducing therein the exhaust gas through small holes 6*a* formed in the center pipe 6, and a resonance chamber 7*b* held in communication with a downstream opened end 6*b* of the center pipe 6, so that the exhaust gas introduced into the resonance chamber 7*b* from the downstream opened end 6*b* of the center pipe 6 can have an exhaust sound muted with a specified frequency due to Helmholtz resonator effect.

Here, if the pipe length of the projection portion of the center pipe 6 projecting into the resonance chamber 7*b* is $L_1$(m), the cross sectional area of the center pipe 6 is S($m^2$), the volume of the resonance chamber 7*b* is V($m^3$), and the velocity of sound in air is c(m/s), the resonance frequency fn(Hz) in the air can be obtained by a following equation (1) in regard to the Helmholtz resonator effect.

$$f_n = \frac{c}{2\pi}\sqrt{\frac{S}{L_1 \cdot V}} \tag{1}$$

As apparent from the equation (1), the resonance frequency can be tuned to a low frequency side by making large the volume V of the resonance chamber 7*b* or otherwise by making long the pipe length $L_1$ of the projection portion of the center pipe 6 while can be tuned to a high frequency side by making small the volume V of the resonance chamber 7*b* or otherwise by making short the pipe length $L_1$ of the projection portion of the center pipe 6.

The sub-muffler 9 is adapted to suppress the sound pressure from being increased with the column air resonance generated in response to the pipe length of the tail pipe 8 in the tail pipe 8 by the pulsation of the exhaust gas during the operation of the engine 1.

In general, the tail pipe 8 having an upper stream opened end 8*a* and a lower stream opened end 8*b* at the respective upstream and downstream sides of the exhaustion direction of the exhaust gas is subjected to incident waves caused by the pulsation of the exhaust gas during the operation of the engine 1 at the upper stream opened end 8*a* and the lower stream opened end 8*b*, thereby generating an air column resonance with a wavelength. The air column resonance has a basic component of a frequency with a half wavelength equal to the pipe length L of the tail pipe 8, and has frequencies several times higher than that of the half wavelength.

More specifically, the wavelength $\lambda_1$ of the air column resonance of a basic vibration (primary component) is roughly double the pipe length L of the tail pipe 8, while the wavelength $\lambda_2$ of the air column resonance of the secondary component is roughly one time the pipe length L of the tail pipe 8. The wavelength $\lambda_3$ of the air column resonance of the third component is ⅔ times the pipe length L of the tail pipe 8. Therefore, the tail pipe 8 has therein standing waves having respective nodes of sound pressures at the upper stream opened end 8*a* and the lower stream opened end 8*b*.

The column air resonance frequency fa can be represented by a following equation (2).

$$fa = \frac{c}{2L}n \tag{2}$$

Here, "c" represents the velocity of sound (m/s), "L" represents the pipe length of the tail pipe (m), and "n" represents a harmonic degree. As apparent from the equation (2), the velocity of sound "c" has a constant value responsive to an ambient temperature. The longer the pipe length L of the tail pipe 8 becomes, nearer the air column frequency "fa" moves to the low frequency side, thereby making it easy to give rise to a noise problem caused by the air column resonance of the exhaust sound in the low frequency area.

For example, if the velocity of sound "c" is 400 m/s, the primary component "$f_1$" and the secondary component "$f_2$" of the exhaust gas sound by the air column resonance respectively become 166.7 Hz and 333.3 Hz in the case of the pipe length "L" of the tail pipe 8 being 1.2 m. On the other hand, the primary component "$f_1$" and the secondary component "$f_2$" of the exhaust gas sound by the air column resonance respectively become 66.7 Hz and 133.3 Hz in the case of the pipe length "L" of the tail pipe 8 being 3.0 m. It is therefore understood that the longer the pipe length L of the tail pipe 8 becomes, nearer the air column frequency "fa" moves to the low frequency side.

The frequency "fe(Hz)" of the exhaust gas pulsation of the engine 1 is represented by a following equation (3).

$$fe = \frac{Ne}{60} \times \frac{N}{2} \tag{3}$$

Here, "Ne" is an engine speed (rpm), and "N" is a number of cylinders of the engine (natural number).

The sound pressure level (dB) of the exhaust gas sound becomes remarkably high in the primary component "$f_1$" of the exhaust gas by the air column resonance generated in response to a specified engine speed "Ne". Further, the sound pressure level (dB) of the exhaust gas sound also becomes remarkably high in the secondary component "$f_2$".

For example, if the velocity of sound "c" is 400 m/s, and the number "N" of the cylinder is set at "4" for the 4-cylider engine, there is caused an air column resonance having a primary component "$f_1$" of the frequency 66.7 Hz when the engine speed "Ne" becomes 2000 rpm, while another air column resonance having a secondary component "$f_2$" of the frequency 133.3 Hz is caused when the engine speed "Ne" becomes 4,000 rpm in the case of the pipe length "L" of the tail pipe 8 being 3.0 m.

Especially in the case that the air column resonance is generated in the low frequency area below 100 Hz of the frequency of the exhaust gas pulsation of the engine 1, there is caused a problem in sound. For example when the air column resonance is generated in the tail pipe 8 at a low engine speed of 2000 rpm, the exhaust gas sound is transmitted to the passenger room of the vehicle, thereby leading to generation of a muffled sound and thus to giving an unpleasant feeling to a driver.

For this reason, there is provided a sub-muffler 9 smaller in volume than the main muffler 7 at the optimum position of the tail pipe 8 with respect to an antinode portion having a high sound pressure of a standing wave generated by the air column resonance, thereby preventing the air column resonance from being generated.

Therefore, for example if the sound velocity "c" is 400 m/s, and the pipe length "L" of the tail pipe 8 is 3.0 m with no sub-muffler 9, there is caused an air column resonance below 100 Hz of the frequency of the exhaust gas pulsation of the engine 1 (below 3,000 rpm of the engine speed "Ne") as previously mentioned. In contrast, if the sub-muffler 9 is supported on the tail pipe 8, and the pipe length "L" of the tail pipe 8 extending rearwardly of the sub-muffler 9 is 1.5 m, the primary component "$f_1$" of the exhaust gas sound by the air column resonance is 133.3 Hz, and the engine speed "Ne" is 4,000 rpm, thereby leading to causing the air column frequency fa to move to the high frequency side.

For this reason, the sub-muffler 9 supported on the tail pipe 8 can suppress the muffled sound in the passenger room at the low speed, viz., 2000 rpm of the rotation speed of the engine 1, thereby preventing an unpleasant feeling from being given to the driver.

On the other hand, it is considered to reduce the production cost and the weight of the exhaust gas apparatus 4 by eliminating the previously mentioned sub-muffler 9. As one of the measures, it is considered to tune the resonance frequency of the main muffler 7 connected to the upper stream opened end 8*a* of the tail pipe 8 with the frequency of the air column resonance to mute the exhaust gas sound of the air column resonance of the tail pipe 8 in the resonance chamber of the main muffler 7.

More specifically, it may be considered that in accordance with the equation (1), the volume "V" of the resonance chamber 7*b* is expanded, or the length $L_1$ of the projection portion of the center pipe 6 is lengthened to conduct the tuning of the resonance frequency of the resonance chamber 7*b* toward the low frequency side, thereby preliminarily muting in the resonance chamber 7*b* the air column resonance generated in the tail pipe 8.

CITATION LIST

Patent Literature

{PTL 1} Patent Publication No. JP2006-46121

SUMMARY OF INVENTION

Technical Problem

However, the conventional exhaust gas apparatus of the engine 1 encounters such a problem that such a construction to reduce the air column resonance of the tail pipe 8 with the resonance chamber 7*b* of the main muffler 7 requires the volume of the resonance chamber 7*b* to be made large, thereby leading to making the main muffler 7 in a large size. The main muffler 7 made in a large size leads to such a problem as increasing not only the weight of the exhaust gas apparatus 4 but also the production cost of the exhaust gas apparatus 4.

The accelerator pedal is released during the speed reduction operation of the vehicle, so that only an exhaust gas stream is generated with the gas amount discharged into the exhaust gas apparatus 4 being rapidly decreased, thereby making small the pressure of air to be introduced into the resonance chamber 7*b*.

For this reason, it is impossible to obtain the amount of air sufficient to achieve the Helmholtz resonance effect in the resonance chamber 7*b*, thereby leading to making it difficult to suppress the air column resonance of the tail pipe 8. Especially due to the rapid decrease of the rotation speed of the engine 1 during the speed reduction operation of the vehicle, there is caused a muffled sound in the passenger room in the vehicle at around the low rotation speed of 2000 rpm (the primary component "$f_1$" of the exhaust gas sound by the air column resonance), thereby giving an unpleasant feeling to the driver.

It is therefore required to provide the sub-muffler 8 at the optimum position of the tail pipe 8 to suppress the sound pressure by the air column resonance of the tail pipe 8 from being increased. As a consequence, there is caused such a problem that the weight of the exhaust gas apparatus 4 is increased, and the production cost of the exhaust gas apparatus 4 is also increased.

The present invention is made to solve the previously mentioned problem, and has an object to provide an exhaust gas apparatus, which does not require to have the sub-muffler supported on the tail pipe or to provide a sound deadening device having a resonance chamber with a large volume at the upstream opened end of the tail pipe, and which can suppress the sound pressure level by the air column resonance of the tail pipe 8 from being increased, thereby making it possible to reduce the weight and the production cost of the exhaust gas apparatus.

Solution to Problem

The exhaust gas apparatus of the internal combustion engine according to the present invention, to solve the previously mentioned problem, comprises an exhaust gas pipe having at one end portion an upstream opened end connected to a sound deadening device positioned at an upstream side of exhaust gas discharged from an internal combustion engine, and at the other end portion a downstream opened end through which the exhaust gas is discharged to the atmosphere, and a plate formed with an opened portion and provided at at least one of the upstream opened end and the downstream opened end in opposing relationship with an exhaust gas discharging direction, the exhaust gas pipe being formed at its peripheral wall axially inwardly spaced apart from the plate by a predetermined distance with respect to the inner diameter of the exhaust gas pipe with a through bore passing through the outer peripheral portion and the inner peripheral portion of the exhaust gas pipe.

The exhaust gas apparatus of the internal combustion engine according to the present embodiment is provided with a plate formed with an opened portion and provided at at least one of the upstream opened end and the downstream opened end, thereby making it possible to allow the exhaust gas pipe to introduce therein the exhaust gas pulsating with the operation of the internal combustion engine and to generate the exhaust gas sound and cause an incident wave in the exhaust gas pipe. When the frequency of the exhaust gas sound is matched with the frequency of the air column frequency of the tail pipe, the incident wave of the exhaust gas sound is divided into two reflection waves including a reflection wave generated by, so called, an opened end reflection caused from the opened portion of the plate to have a phase the same as the incident wave of the exhaust gas sound, and a reflection wave generated by, so called, a closed end reflection caused from the closed portion to have a phase 180 degrees different from the incident wave. Further, the exhaust gas pipe is formed with a through bore at its peripheral wall axially inwardly spaced apart from the plate by a predetermined distance, so that by correcting the reflection position of the reflection wave caused at the opened end, the reflection position of the reflection wave caused by the opened end reflection can precisely be matched with the reflection position of the reflection wave caused by the closed end reflection, and the phase difference between the reflection wave by the opened end reflection and the reflection wave caused by the closed end reflection can be made 180 degrees, thereby making it possible to make the sound pressure levels completely different from each other and to make the reduce the sound pressure levels maximum by the inferences of the sound pressure levels.

In this way, the air column resonance in the exhaust gas pipe can be suppressed from being generated, and the sound pressure levels by the air column resonance in the exhaust gas pipe can be suppressed from being increased, thereby making it possible to reduce the muffled sound in the passenger room at the time of the low rotation of the internal combustion engine as seen in the conventional problem. As a consequence, there is no need for making large in size the sound deadening device corresponding to the main muffler and for providing a sub-muffler in the exhaust gas pipe, thereby preventing the exhaust gas apparatus from being increased in weight and production cost.

The exhaust gas apparatus is preferably constructed to have a through bore formed at the lower portion of the exhaust gas pipe to extend in the gravity direction.

In the exhaust gas apparatus constructed as previously mentioned, the through bore is formed at the lower portion of the exhaust gas pipe, so that the through bore can easily discharge condensed water and the like remaining in the exhaust gas pipe through the through bore.

The exhaust gas apparatus constructed as previously mentioned is preferably constructed to have an open portion having an opened area set at one third the total area of the plate having a closed portion closing the cross section of the exhaust gas pipe in addition to the opened portion.

In the exhaust gas apparatus thus constructed, the opened area of the open portion having a reflection surface for reflecting the sound wave is set at one third the total area of the plate, so that the reflection rate of the sound wave can be 0.5, thereby causing the reflection wave by the closed end reflection and the reflection wave by the opened end reflection to be generated at the ratio of 1:1. The reflection waves 180 degrees different in phase and generated at the same level interfere with and cancel each other, and thus can enhance the effect of reducing the sound pressure level.

Advantageous Effects of Invention

The present invention can provide an exhaust gas apparatus, which does not require any sub-muffler to be supported on the tail pipe nor any sound deadening device to be provided with a resonance chamber having a large volume at the upstream opened end of the tail pipe, and which can suppress the sound pressure level by the air column resonance of the tail pipe from being increased, thereby making it possible to reduce the weight and the production cost of the exhaust gas apparatus.

DESCRIPTION OF EMBODIMENTS

The embodiments of the exhaust gas apparatus of the internal combustion engine according to the present invention will be described hereinafter with reference to the drawings.

FIGS. 1 to 18 show the embodiments of the exhaust gas apparatus of the internal combustion engine according to the present invention.

First, the construction of the embodiments will be explained.

Figure 1:
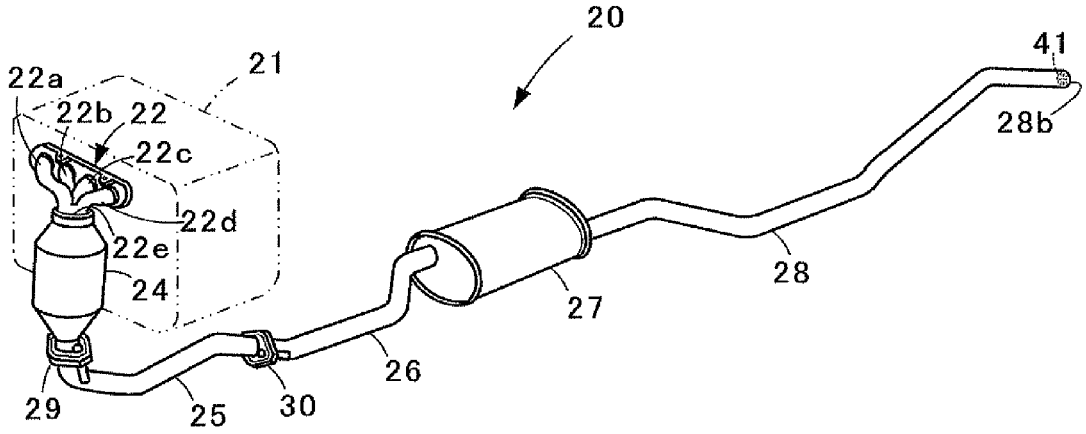
FIG. 1 shows one embodiment of an exhaust gas apparatus of an internal combustion engine according to the present invention, and is a perspective view showing the construction of an exhaust gas system of the internal combustion engine.

The exhaust gas apparatus 20 of the internal combustion engine according to the present invention is shown in FIG. 1 to be applied to an engine 21 serving as a straight 4-cylinder internal combustion engine, and connected to an exhaust gas manifold 22 connected to the engine 21. The exhaust gas apparatus 20 is adapted to purify an exhaust gas discharged from the engine 21, and then to discharge the exhaust gas into the atmosphere while suppressing exhaust gas sound.

The engine 21 is not limited to the above straight 4-cylinder engine, and may be a straight 3-cylinder engine, a straight 5-cylinder engine, and other engines each having more cylinders. The engine 21 may be a V-engine having more than 3-cylinders respectively mounted on the banks divided right and left.

The exhaust gas manifold 22 is constituted by four exhaust gas branch pipes 22*a*, 22*b*, 22*c*, 22*d* respectively connected to exhaust ports formed to be held in communication with the first to fourth cylinders of the engine 21, and an exhaust gas collecting pipe 22*e* constructed to collect the downstream sides of the exhaust gas branch pipes 22*a*, 22*b*, 22*c*, 22*d*, so that the exhaust gas discharged from the cylinders of the engine 21 can be introduced into the exhaust gas collecting pipe 22*e* through the exhaust gas branch pipes 22*a*, 22*b*, 22*c*, 22*d*.

The exhaust gas apparatus 20 is provided with a catalytic converter 24, a cylindrical front pipe 25, a cylindrical center pipe 26, a muffler 27 serving as a sound deadening device, and a tail pipe 28 serving as a cylindrical exhaust gas pipe. The exhaust gas apparatus 20 is installed at the downstream side of the exhaust gas discharging direction of the engine 21 in such a manner that the exhaust gas apparatus 20 is resiliently hanging from the floor of the vehicle. The term "upstream side" indicates an upstream side in the discharging direction of the exhaust gas, while the term "downstream side" indicates a downstream side in the discharging direction of the exhaust gas.

The upstream end of the catalytic converter 24 is connected to the downstream end of the exhaust gas collecting pipe 22*e*, while the downstream end of the catalytic converter 24 is connected to the front pipe 25 through a universal joint 29. The catalytic converter 24 is constructed by a case housing therein a honeycomb substrate or a granular activated alumina-made carrier deposited with catalysts such as platinum and palladium to perform reduction of NOx, and oxidization of CO, HC.

The universal joint 29 is constructed by a spherical joint such as a ball joint and the like to allow the catalytic converter 24 and the front pipe 25 to be relatively displaced with each other. The downstream end of the front pipe 25 is connected to the upstream end of the center pipe 26 through a universal joint 30. The universal joint 30 is constructed by a spherical joint such as a ball joint and the like to allow the front pipe 25 and the center pipe 26 to be relatively displaced with each other.

The downstream end of the center pipe 26 is connected to the muffler 27 adapted to mute the exhaust sound.

Figure 2:
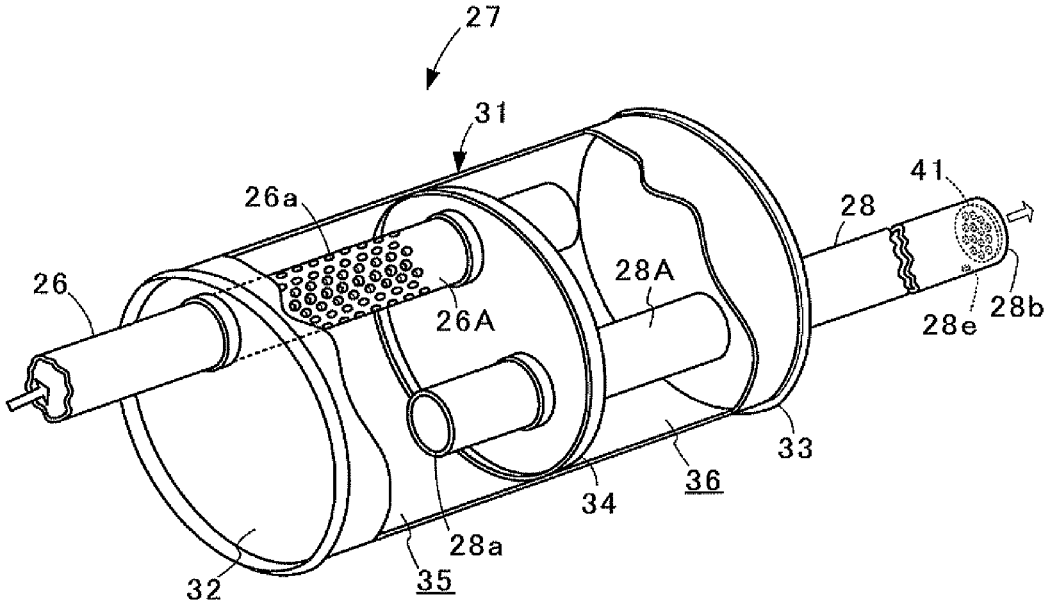
FIG. 2 shows one embodiment of the exhaust gas apparatus of the internal combustion engine according to the present invention, and is a perspective view of a muffler connected to a tail pipe and fragmentarily cross-sectioned.
Figure 3:
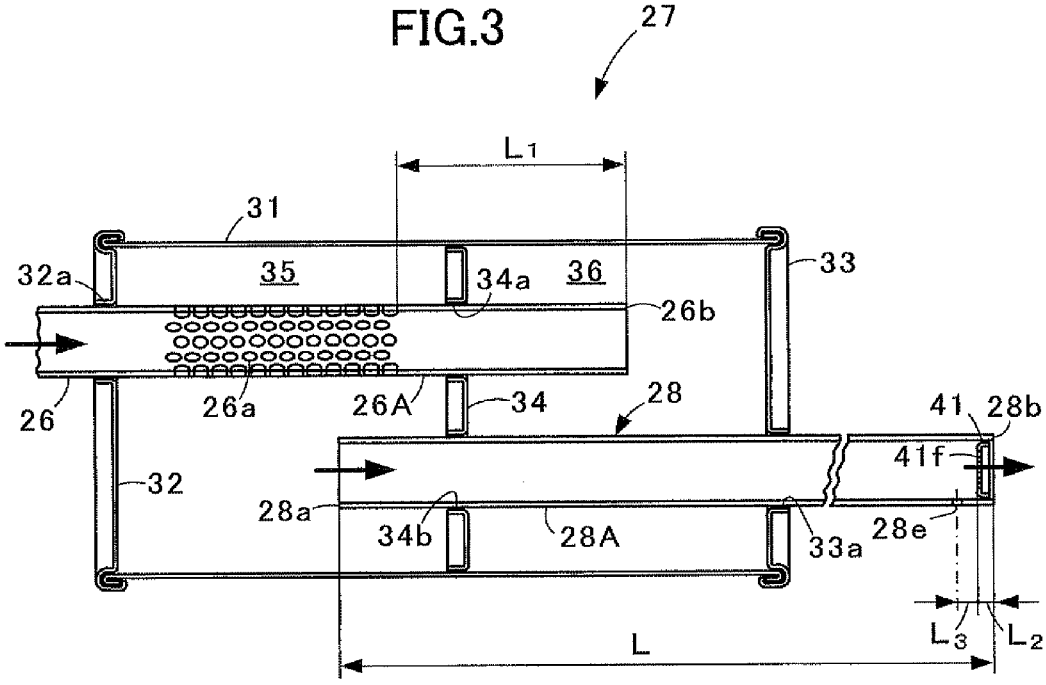
FIG. 3 shows one embodiment of the exhaust gas apparatus of the internal combustion engine according to the present invention, and is a longitudinally cross-sectioned view of the muffler cross-sectioned on a plane passing the center axis of the tail pipe and a center axis of a center pipe shown in FIG. 2.

As shown in FIGS. 2 and 3, the muffler 27 is provided with an outer shell 31 formed in a cylindrical shape, end plates 32, 33 for closing the both ends of the outer shell 31, and a partition plate 34 intervening between the end plate 32 and the end plate 33. The outer shell 31, and the end plates 32, 33 collectively constitute a sound deadening body. The muffler 27 according to the present embodiment is corresponding to the sound deadening device according to the present invention.

The partition plate 34 provided in the outer shell 31 divides the outer shell 31 into an expansion chamber 35 for expanding the exhaust gas in the outer shell 31, and a resonance chamber 36 for muting the exhaust sound with a specified frequency by the Helmholtz resonance effect. The end plate 32 and the partition plate 34 are formed with through bores 32*a*, 34*a*, respectively. The through bores 32*a*, 34*a* allow the downstream end portion of the center pipe 26, viz., an inlet pipe portion 26A forming part of the center pipe 26 to be accommodated in the muffler 27.

The inlet pipe portion 26A is supported on the end plate 32 and the partition plate 34 and accommodated in the expansion chamber 35 and the resonance chamber 36 in such a manner that the downstream opened end 26*b* is opened to the resonance chamber 36.

The inlet pipe portion 26A is formed with a plurality of small through bores 26*a* formed to be arranged in the axial direction (the discharging direction of the exhaust gas) and the circumferential direction of the inlet pipe portion 26A, so that the inner chamber of the inlet pipe portion 26A is held in communication with the expansion chamber 35 through the small through bores 26*a*.

Therefore, the exhaust gas introduced into the muffler 27 through the inlet pipe portion 26A of the center pipe 26 is introduced into the expansion chamber 35 through the small through bores 26 and into the resonance chamber 36 through the downstream opened end 26*b* of the inlet pipe portion 26A.

The exhaust sound of the exhaust gas with a specified frequency (Hz) can be muted by the Helmholtz resonance effect when being introduced into the resonance chamber 36.

If the length of the projection portion of the inlet pipe portion 26A projecting into the resonance chamber 36 is represented by $L_1$(m), the cross-section area of the inlet pipe portion 26A is represented by S($m^2$), the volume of the resonance chamber 36 is represented by V($m^3$), and the sound velocity in the air is represented by c(m/s), the resonance frequency $f_b$(Hz) can be obtained by the following equation regarding Helmholtz resonance.

$$f_b = \frac{c}{2\pi}\sqrt{\frac{S}{L_1 \cdot V}} \tag{4}$$

As apparent from the equation (4), the fact that the volume V of the resonance chamber 36 is made small, the length $L_1$ of the projection portion of the inlet pipe portion 26A is made short, or the cross-section area S of the inlet pipe portion 26A is made large makes it possible to tune the resonance frequency toward its high frequency. On the other hand, the fact that the volume V of the resonance chamber 36 is made large, the length $L_1$ of the projection portion of the inlet pipe portion 26A is made long, or the cross-section area S of the inlet pipe portion 26A is made small makes it possible to tune the resonance frequency toward its low frequency.

On the other hand, the partition plate 34 and the end plate 33 are respectively formed with the through bores 34*b*, 33*a* which allow the upstream end portion of the tail pipe 28, viz., an outlet pipe portion 28A forming part of the tail pipe 28 accommodated in the muffler 27 to pass therethrough.

The tail pipe 28 is constructed by a cylindrical pipe and provided with a circular plate 41. The upstream end portion of the outlet pipe portion 28A is provided with an upstream opened end 28*a*, while the downstream end portion of the tail pipe 28 is provided with a downstream opened end 28*b* spaced apart from the upstream opened end 28*a* by the distance L. The outlet pipe portion 28A is connected to the muffler 27 to pass through the through bores 34*b*, 33*a* in such a manner that the upstream opened end 28*a* is opened in the expansion chamber 35.

Figure 4:
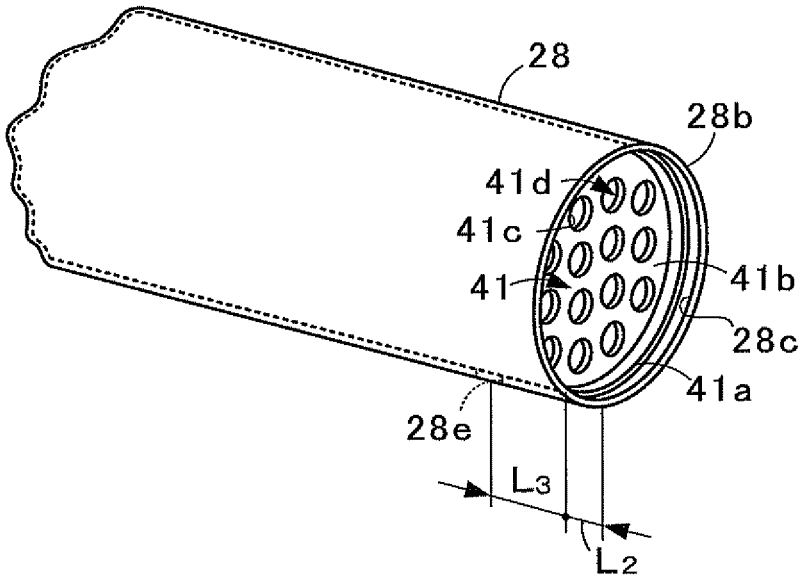
FIG. 4 shows one embodiment of the exhaust gas apparatus of the internal combustion engine according to the present invention, and is a perspective view of a downstream opened end of the tail pipe.
Figure 5:
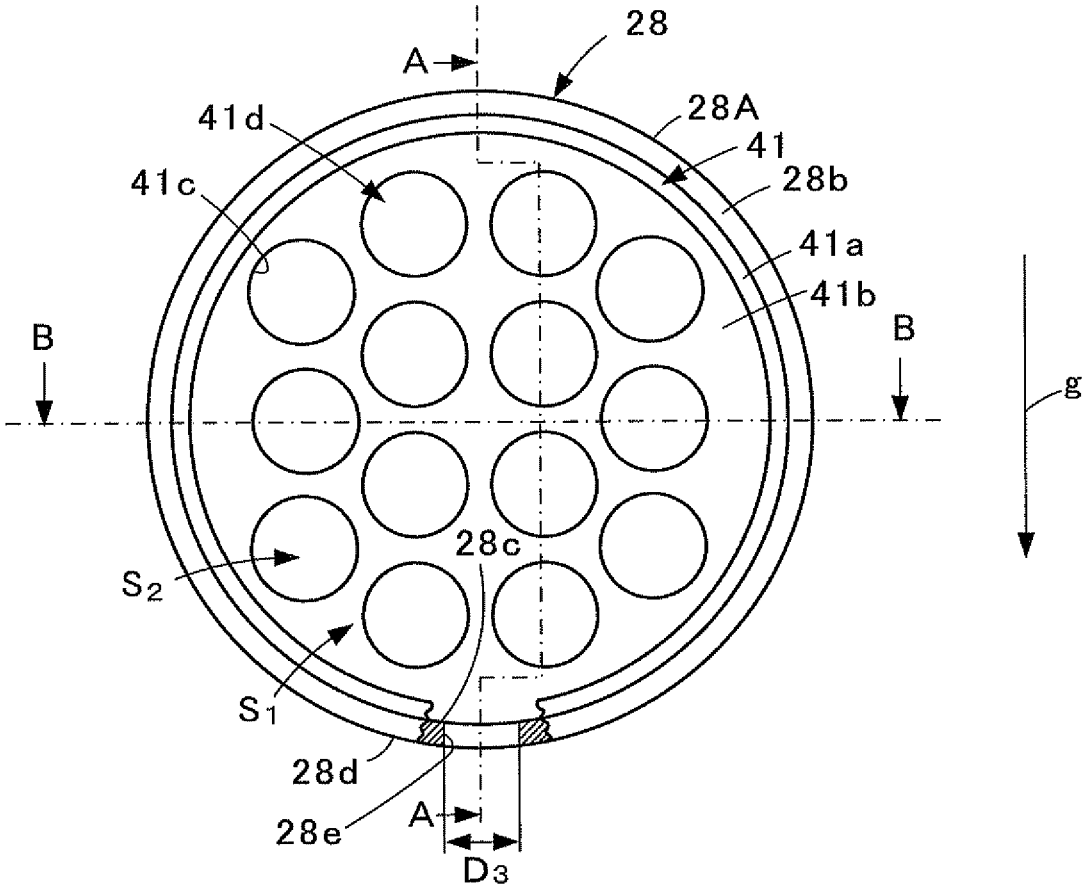
FIG. 5 shows one embodiment of the exhaust gas apparatus of the internal combustion engine according to the present invention, and is a front view of the downstream opened end of the tail pipe.
Figure 6:
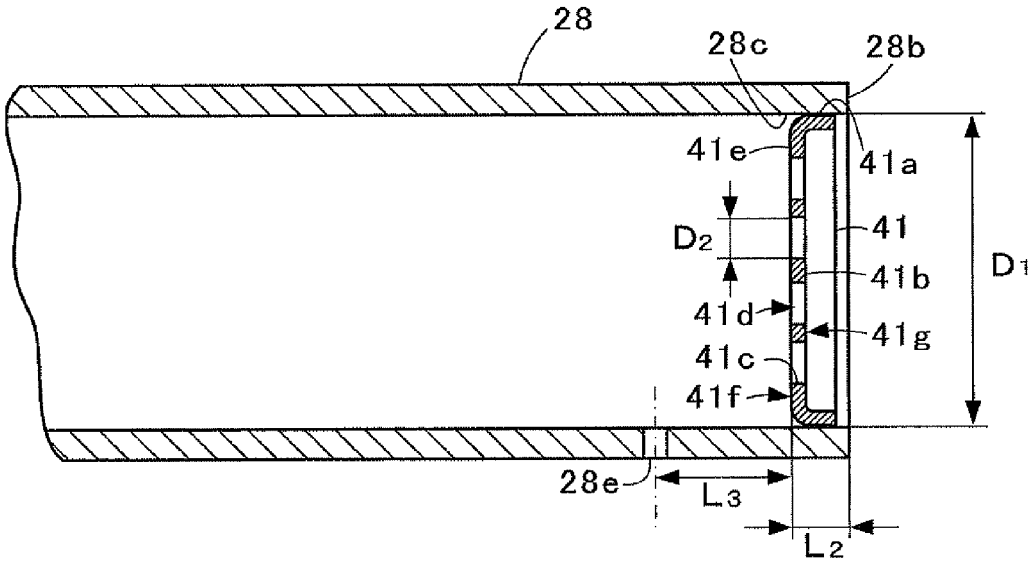
FIG. 6 shows one embodiment of the exhaust gas apparatus of the internal combustion engine according to the present invention, and is a cross-sectional view taken along the line A-A in FIG. 5.

As shown in FIGS. 4 to 6, the plate 41 is provided at the downstream opened end 28*b* of the tail pipe 28, and has an outer peripheral portion 41*a* formed to axially outwardly extend and having a diameter $D_1$, and a side surface portion 41*b* opposing the exhaust direction of the exhaust gas flowing in the tail pipe 28. The side surface portion 41*b* has an opened portion 41*d* formed with fourteen circular through bores 41*c* each having a diameter $D_2$, and a closed portion 41*e* remaining other than the opened portion 41*d*.

The side surface portion 41*b* has a reflection surface portion 41*f* opposing the exhaust gas discharging direction, and an opposing surface portion 41*g* opposing the reverse direction of the exhaust gas discharging direction. The through bores 41*c* of the opened portion 41*d* are formed to extend between the reflection surface portion 41*f* and the opposing surface portion 41*g* to allow the exhaust gas to be discharged to the atmosphere.

Here, the plate 41 is provided to oppose the exhaust direction of the exhaust gas flowing in the tail pipe 28, but, more concretely, secured to the tail pipe 28 in perpendicular relationship with the axial direction of the tail pipe 28. The plate 41 is secured to the tail pipe 28 in such a manner that the outer peripheral portion 41*a* of the plate 41 and the inner peripheral portion 28*c* of the tail pipe 28 are held in tight contact with and thus hermetically sealed with each other. Here, the methods of securing the plate 41 to the tail pipe 28 are preferably securing methods such as a jointing method, a pressurizing method and the like. In lieu of these securing methods, the method of securing the plate 41 to the tail pipe 28 may be integrally formed by a drawing process and the like.

The plate 41 is attached to the tail pipe 28 with its outer peripheral portion 41*a* being secured to the inner peripheral portion 28*c* of the tail pipe 28 in such a manner that the reflection surface portion 41*f* of the side surface portion 41*b* at the upstream side of the exhaust gas discharging direction is spaced apart from the downstream opened end 28*b* of the tail pipe 28 by the distance $L_2$. The plate 41 may be secured to the inner peripheral portion 28*c* of the tail pipe 28 in such a manner that the outer peripheral portion 41*a* is provided to axially inwardly extend, and the side surface portion 41*b* is arranged to be axially aligned with the downstream opened end 28*b* of the tail pipe 28.

This means that the distance $L_2$ may be zero. In other words, the side surface of the side surface portion 41*b* at the upstream side of the exhaust gas discharging direction and the downstream opened end 28*b* are arranged to be flush with each other. As shown in FIGS. 5 and 6, the side surface portion 41*b* of the plate 41 has an opened portion 41*d* formed with fourteen circular through bores 41*c* each having a diameter $D_2$, and a closed portion 41*e* remaining other than the opened portion 41*d*. The side surface portion 41*b* is adapted to allow an opened end reflection to be caused at the opened portion 41*d* against an incident wave incident to the tail pipe 28 and to allow a closed end reflection to be caused at the closed portion 41*e* against the incident wave incident to the tail pipe 28. This means that the reflection of the exhaust gas sound is caused at the reflection surface portion 41*f* of the plate 41.

In this case, the opened end reflection and the closed end reflection distributed at the opened portion 41*d* and the closed portion 41*e* cancel each other to result in muting the exhaust gas sound, i.e., the reflection sound. Further, the reflection surface portion 41*f* has a surface to reflect the incident wave and the reflection wave. The reflection surface portion 41*f* is thus constituted by part of the opened portion 41*d* and the closed portion 41*e*.

Here, in these opened end reflections, more strictly, a traveling wave propagating through the tail pipe 28 is reflected at a position spaced apart from the opened portion 41*d* of the downstream opened end 28*b* toward the downstream side by the length ΔL. Therefore, in order that the accurate frequency of the air column is obtained, it is required to amend the ΔL distance from the opened portion 41*d* by an amendment, which is called an opened end amendment. The length ΔL of the opened end amendment is known to be different depending upon the inner diameters of the pipes.

In the tail pipe 28, there exists a medium such as an exhaust gas the same as the exhaust gas in the tail pipe 28 outside of the opened portion 41*d* of the downstream opened end 28*b*, so that the energy (J) of sound is, strictly, transmitted to the outside of the tail pipe 28. This means that the pressure of sound (Pa) is not zero at the opened portion 41*d* of the downstream opened end 28*b*. This leads to the fact that the position axially outwardly spaced apart from the opened portion 41*d* of the downstream opened end 28*b* toward the downstream side by ΔL becomes a substantially effective pipe end. As a consequence, the incident wave is reflected at the substantially effective pipe end axially outwardly spaced apart from the opened portion 41*d* of the downstream opened end 28*b* by ΔL. In order that, in the tail pipe 28 in the present embodiment, the position of the substantially effective pipe end is coincident with the opened portion 41*d* of the downstream opened end 28*b*, the axially inner portion of the tail pipe 28 is formed with a through bore, which will be described in detail hereinafter.

Figure 7:
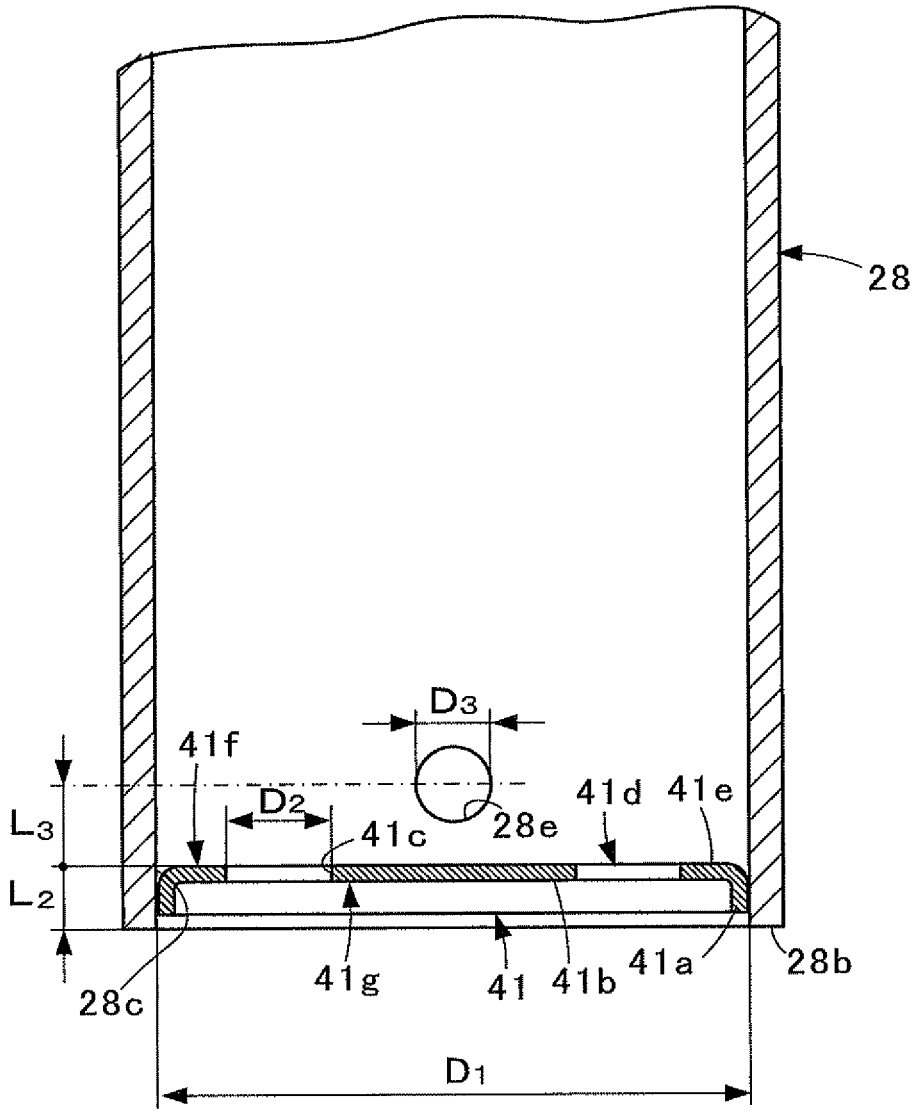
FIG. 7 shows one embodiment of the exhaust gas apparatus of the internal combustion engine according to the present invention, and is a cross-sectional view taken along the line B-B in FIG. 5.
Figure 8:
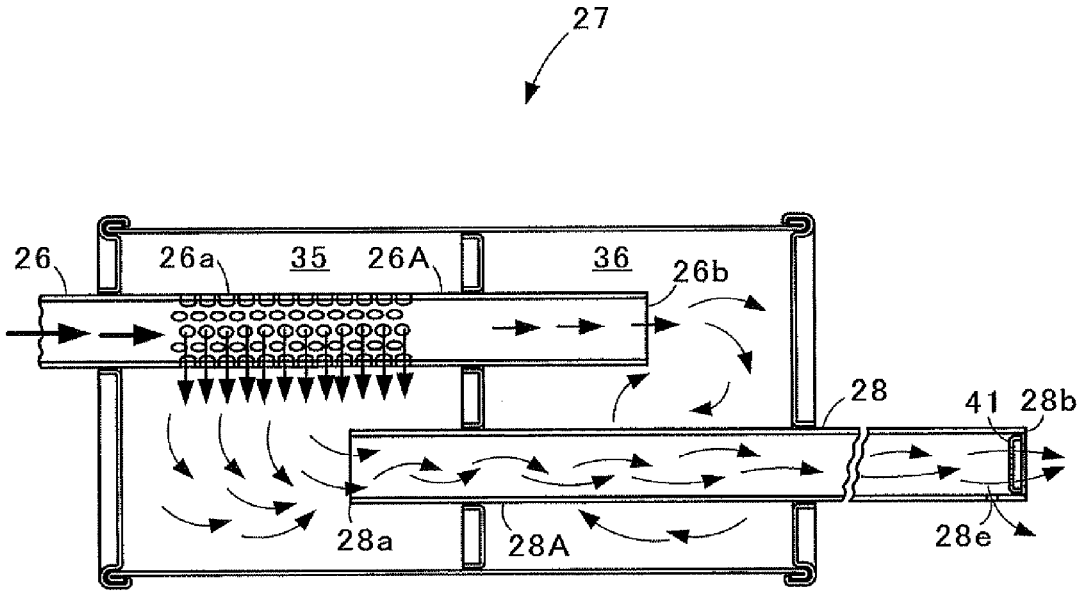
FIG. 8 shows one embodiment of the exhaust gas apparatus of the internal combustion engine according to the present invention, and flows of an exhaust gas in the muffler and the tail pipe.

As shown in FIGS. 5, 6 and 7, the tail pipe 28 is fanned with a through bore 28*e* passing through the peripheral wall of the tail pipe 28, viz., passing through between the inner peripheral portion 28*c* and the outer peripheral portion 28*d* and having a diameter $D_3$. The through bore 28*e* is formed axially inwardly of the tail pipe 28 by the distance $L_3$ from the side surface portion 41*b* of the plate 41 with respect to the reflection surface portion 41*f* of the side surface portion 41*b* of the plate 41. The through bore 28*e* is formed at the lower portion of the tail pipe 28 to extend in the gravity direction of the tail pipe 28, viz., in the downward direction of the vehicle body.

The through bore 28*e* is formed at a position axially inwardly spaced apart from the side surface portion 41*b* of the plate 41 by the distance L3 having a predetermined ratio with respect to the inner diameter $D_1$ of the tail pipe 28. It is preferable that the center portion of the through bore 28*e* be provided at the position spaced apart from the closed portion 41*e* of the reflection surface portion 41*f* by the distance ΔL obtained through the opened end amendment. The preferred length of the distance ΔL obtained through the opened end amendment will be described hereinafter.

Further in order to obtain an optimum sound deadening effect to the reflection sound, the opened portion 41*d* is formed with the opened area $S_2$ ($m^2$) of the opened portion 41*d* and the total area $S_1$ ($m^2$) of the side surface portion 41*b* including the opened portion 41*d* of the plate 41 shown in FIG. 5 that is obtained through the following equation (5).

If the diameter of the plate 41 is represented by $D_1$, and the diameter of the through bore 41*c* of the opened portion 41*d* is represented by $D_2$, the total area $S_1$ is given by $II(D_1/2)^2$, and the opened area $S_2$ is given by $SII(D_{22})^2\times14$.

$$S_2=\tfrac{1}{3}S_1 \tag{5}$$

In order to obtain the optimum deadening effect of the reflection sound, the opened end reflection and the closed end reflection are preferably required to be half and half, respectively. Further in order to obtain this distribution ratio, the reflection rate of the exhaust sound incident to the plate 41 is required to be 0.5. These above facts are well known in the art.

Here, if the reflection rate of the exhaust gas sound is represented by Rp, an inherent acoustic impedance of a medium in the tail pipe 28 is represented by $Z_1$, and an inherent acoustic impedance of a medium in the neighborhood of the downstream opened end 28*b* outside of the tail pipe 28 is represented by $Z_2$, the reflection rate Rp of the exhaust gas sound is given by the following equation (6). Fundamentally, the reflection rate Rp of the exhaust gas sound is represented with the relationship between the inherent acoustic impedances $Z_1$ and $Z_2$. Due to the fact that the total area $S_1$ of the opened portion 41*d* of the plate 41 including the opened portion 41*d* and the opened area $S_2$ are not large in variations of their cross-sectional areas and the sound waves flatly and continuously propagate, the reflection rate Rp of the exhaust gas sound can be given by the values with the inherent acoustic impedances $Z_1$ and $Z_2$ of the mediums respectively multiplied by each of the above cross-sectional areas. Namely, the reflection rate Rp of the exhaust gas sound can be given by the following equation (6) since $Z_1$ can be represented by $Z_1S_1$, while $Z_2$ can be represented by $Z_2S_2$.

$$Rp = \frac{Z_2S_2 - Z_1S_1}{Z_1S_1 + Z_2S_2} \tag{6}$$

Here, the inherent acoustic impedance can be represented by the product of the medium density $\rho(Kg/m^3)$ and the velocity of sound c(m/s), thereby obtaining the equations $Z_1=\rho_1c_1$ and $Z_2=\rho_2c_2$. The medium of the density $\rho_1$ and the velocity $c_1$ of sound in the tail pipe 28, and the medium of the density $\rho_2$ and the velocity $c_2$ of sound indicate the exhaust gas. It may be possible that the medium becomes air when the engine 21 is operated under no fuel injection condition. In the case of the medium being the exhaust gas and air, the equations $\rho_1c_1=\rho_2c_2$ and $Z_1=Z_2$ can be obtained. The reflection rate Rp is therefore given by the following equation (7).

$$Rp = \frac{S_2 - S_1}{S_1 + S_2} \tag{7}$$

When the equation (7) is substituted by the optimum value 0.5 of the reflection rate Rp, the above equation (5) can be obtained, showing 33% of the opening rate of the opened portion 41*d* with respect to the total area of the side surface portion 41*b* including the opened portion 41*d* of the plate 41. The above equation shows that the opening rate 33% is the most preferable value, however, if the opening rate of the plate 41 according to the present embodiment is in the range of (33±α)%, it is possible to obtain the optimum deadening effect of the reflection sound with the plate 41.

This is due to the fact that even with the value of the opening rate being other than 33%, the reflection sounds can be cancelled and deadened to some extent with each other by the opened end reflection and the closed end reflection distributed at the opened portion 41*d* and the closed portion 41*e*. There is a possibility that when the opening rate is deviated from the range of (33±α)%, the cancellation effect of the reflection sounds by the opened end reflection and the closed end reflection can not be obtained. Here, "α" is suitably selected based on the dimensions of the vehicle design, the simulation, the experimental data, values and experiences that has so far been applied to the exhaust gas apparatus 20 according to the present embodiment.

The plate 41 is constructed with the opened portion 41*d* allowing the inside of the tail pipe 28 to be in communication with the atmosphere. This construction of the plate 41 makes it possible to discharge the exhaust gas introduced into the upstream opened end 28*a* of the tail pipe 28 from the expansion chamber 35 of the muffler 27 to the atmosphere from the downstream opened end 28*b* through the opened portion 41*d* of the tail pipe 28.

Next, the operation of the exhaust gas apparatus 20 and the reason of generating the air column resonance will be explained hereinafter. When the engine 21 upstream of the exhaust gas apparatus 20 is started, the exhaust gas emitted from each of the cylinders is introduced from the exhaust gas manifold 22 into the catalytic converter 24 by which the reduction of NOx and the oxidations of CO and HC are carried out.

The exhaust gas purified by the catalytic converter 24 is introduced into the muffler 27 of the exhaust gas apparatus 20 through the front pipe 25 and the center pipe 26. The exhaust gas introduced into the muffler 27 is, as shown by arrows in FIG. 8, introduced into the expansion chamber 35 through the small through bores 26*a* of the inlet pipe portion 26A, and then introduced into the resonance chamber 36 through the downstream opened end 26*b* of the inlet pipe portion 26A.

The exhaust gas introduced into the expansion chamber 35 is introduced into the tail pipe 28 through the upstream opened end 28*a* of the outlet pipe portion 28A, and then discharged to the atmosphere through the opened portion 41*d* and the through bore 28*e* of the plate 41 provided at the downstream opened end 28*b* of the tail pipe 28.

The exhaust gas pulsation excited by each of the cylinders of the engine 21 exploded during the operation, of the engine 21 causes the exhaust gas sound having frequencies (Hz) varied in response to the rotation speed (rpm) of the engine 21 to be generated from each of the cylinders of the engine 21. The frequencies of exhaust gas sound are increased as the rotation speeds of the engine 21 are increased. The exhaust gas sound is incident to the inlet pipe portion 26A of the muffler 27 through the exhaust gas manifold 22, the catalytic converter 24, the front pipe 25, and the center pipe 26 in the exhaust gas serving as a medium.

The exhaust gas sound incident to the inlet pipe portion 26A is introduced into the expansion chamber 35 through the small through bores 26*a* of the inlet pipe portion 26A, and expanded to cause the sound pressure level of the exhaust gas sound to be reduced in all the frequency band areas. The exhaust gas sound incident to the inlet pipe portion 26A is then introduced into the resonance chamber 36 through the downstream opened end 26*b*. In the exhaust gas sound introduced into the resonance chamber 36, a specific frequency exhaust gas sound set by the Helmholtz resonance can be deadened.

The exhaust gas sound introduced into the expansion chamber 35 is incident into the tail pipe 28 to become an incident wave which is in turn reflected by the plate 41 at the downstream opened end 28*b* of the tail pipe 28 to become a reflection wave. The reflection wave generated by the opened end reflection and the reflection wave generated by the closed end reflection cancel each other due to the interference therebetween. The reflection wave generated by the opened end reflection and the reflection wave generated by the closed end reflection further reflect each other at the upstream opened end 28*a* of the tail pipe 28 to advance toward the downstream opened end 28*b*, and again reflected by the plate 41 similarly to the incident wave previously mentioned. It is thus to be noted that the reflections thus caused are repeated.

As previously mentioned, the through bore 28*e* is formed at a position axially inwardly with respect to the reflection surface portion 41*f* of the side surface portion 41*b* of the plate 41, thereby making it possible to make the substantially effective reflection surface with respect to the opened end reflection on the reflection surface portion 41*f* of the side surface portion 41*b* of the plate 41, and thus to make the substantially effective reflection surface identical to the reflection surface of the closed end reflection. It is therefore possible to make the phase of the reflection wave by the opened end reflection and the phase of the reflection wave by the closed end reflection exactly different from each other by 180 degrees, and thus to cause the interference reliably canceling the reflection waves.

Further, it may be considered that at the boundary of both the media having the same medium like the opened end of the pipe, there is fundamentally caused no reflection, thereby allowing the sound wave to penetrate through the boundary of the media since the media are the same in medium. However, the exhaust gas sound advancing in the pipe like the tail pipe 28 having a cross-sectional area dimension sufficiently small to the wavelength of the exhaust gas sound becomes a parallel wave made of a compression wave, and thus reflects at the downstream opened end 28*b* and the upstream opened end 28*a*.

The reason why the opened end reflection is caused at the downstream opened end 28*b* will be able to be explained with the following description. The pressure of the exhaust gas flowing in the tail pipe 28 is high, while the atmospheric pressure outside the downstream opened end 28*b* of the tail pipe 28 is lower than the pressure of the exhaust gas flowing in the tail pipe 28. The incident wave is violently discharged out into the atmosphere through the downstream opened end 28*b*, thereby causing a low-pressure portion where the pressure of the exhaust gas inside of the downstream opened end 28*b* become low. This results in the low pressure-portion starting to move in the tail pipe 28 toward the upstream opened end 28*a*.

This means that the reflection wave becomes a parallel wave and advances oppositely to the incident wave. The reason why the reflection wave is generated at the upstream opened end 28*a* is the same as that of the reflection wave generated as previously mentioned.

The incident wave moving toward the opened portion 41*d* of the downstream opened end 28*b* is interfered with the first reflection wave moving in the direction spaced apart from the opened portion 41*d* of the downstream opened end 28*b*. Further, the first reflection wave is reflected at the opening of the upstream opened end 28*a* to become a second reflection wave moving toward the opened portion 41*d*. The second reflection wave is generated repeatedly and interfered with the first reflection wave and the incident wave generated at the upstream opened end 28*a* and the downstream opened end 28*b*. In this way, the reflection of the incident wave is repeated, thereby generating a standing wave between the opening of the upstream opened end 28*a* and the opened portion 41*d* of the downstream opened end 28*b*.

When there exists a special relationship between the pipe length L of the tail pipe 28 and the wavelength $\lambda$ of the standing wave, the standing wave is generated with the opening of the upstream opened end 28*a* of the tail pipe 28 and the opened portion 41*d* of the downstream opened end 28*b* each forming an antinode portion of the particle velocity. Under these conditions, there is generated an air column resonance having a remarkably large amplitude. The air column resonance has a fundamental frequency with a half wavelength equal to the pipe length L of the tail pipe 28. The air column resonance is generated with the frequency having several times the natural number of the fundamental frequency, and with the wavelength having a length obtained by dividing the fundamental wave by the natural number, so that the sound pressure is remarkably increased and thus causes noises.

Figure 9:
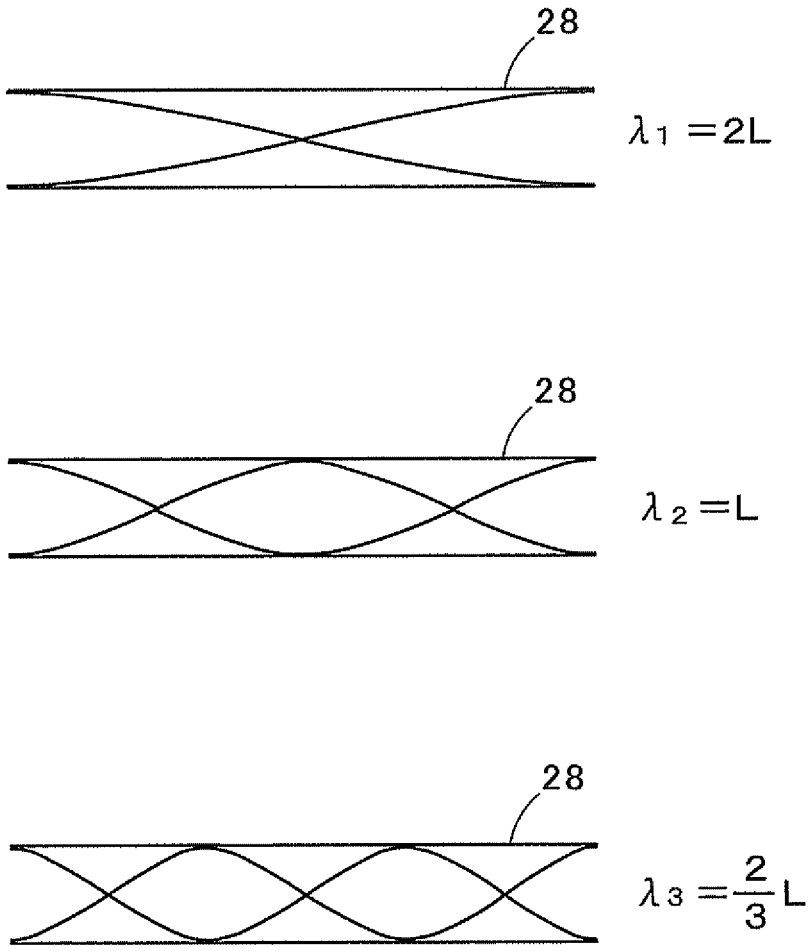
FIG. 9 shows one embodiment of the exhaust gas apparatus of the internal combustion engine according to the present invention, and shows views for explaining standing waves of an air column resonance on a particle velocity distribution, the air column resonance being caused by an opened end reflection generated in the tail pipe, and the particle velocity distribution schematically showing a particle velocity on a vertical axis and a position of the tail pipe on a horizontal axis.

FIG. 9 shows one embodiment of the exhaust gas apparatus of the internal combustion engine according to the present invention, and shows views for explaining standing waves of an air column resonance on a particle velocity distribution. As shown in FIG. 9, the wavelength $\lambda_1$ of the air column resonance of a primary component constituted by a fundamental vibration of the exhaust gas sound is approximately double the pipe length L of the tail pipe 28, while the wavelength $\lambda_2$ of the air column resonance of a second component double the fundamental vibration of the exhaust gas sound is approximately one time the pipe length L of the tail pipe 28. Further, the wavelength $\lambda_3$ of the air column resonance of a tertiary component three times the fundamental vibration of the exhaust gas sound is approximately ⅔ times the pipe length L of the tail pipe 28. As apparent from FIG. 9, each of the standing waves has an antinode portion of particle velocity maximum at the upstream opened end 28*a* and the downstream opened end 28*b*.

The sound pressure distributions of the standing waves of the primary to tertiary components of the exhaust gas sounds have antinode portions and node portions opposite to those the particle velocity distributions as shown in FIG. 9. This means that the sound pressures of the upstream opened end 28*a* and the downstream opened end 28*b* each serves as a node portion of the sound pressure and thus each sound pressure is zero.

Figure 10:
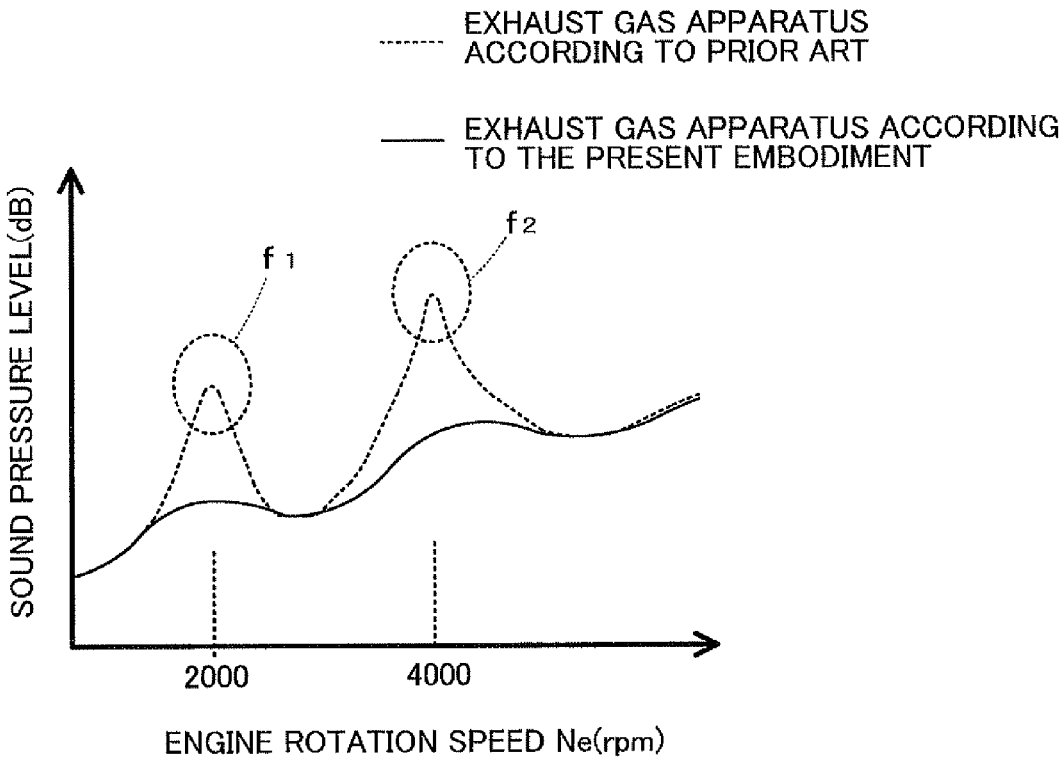
FIG. 10 shows one embodiment of the exhaust gas apparatus of the internal combustion engine according to the present invention, and is a view showing relationship between the sound pressure level of the tail pipe and the rotation speed of the engine.

As shown in FIG. 10, the sound pressure level (dB) of the exhaust gas sound is increased at the engine rotation speed Ne corresponding to the resonance frequency (Hz) of each of the primary component $f_1$, and the secondary component $f_2$ as the engine rotation speed Ne (rpm) is increased.

Here, if the sound velocity is represented by c(m/s), the length of the tail pipe 28 is represented by L (m), and the harmonic degree is represented by "n", the air column resonance frequency fc (Hz) can be given by a following equation (8).

$$fc = \frac{c}{2L}n \tag{8}$$

If the sound velocity "c" is 400 m/s, and the length L of the tail pipe 28 is 3.0 m, the primary component $f_1$ of the exhaust gas sound and the secondary component $f_2$ of the exhaust gas sound by the air column resonance of the tail pipe 28 in accordance with the above equation (8) are 66.7 Hz and 133.3 Hz, respectively. This means that the sound pressure levels (dB) of the exhaust gas sounds become high at the primary component $f_1$ and the secondary component $f_2$ of the resonance frequencies by the air column resonance in response to the rotation speeds of the engine 21.

In the present embodiment, the engine 21 is made of four-cylinders so that in the above equation (3), N is equal to 4, i.e., N=4. When the engine rotation speed Ne is 2000 rpm, the sound pressure level (dB) of the exhaust gas sound at the primary component $f_1$ of the resonance frequency is increased by the air column resonance. When the engine rotation speed Ne is 4,000 rpm, the sound pressure level (dB) of the exhaust gas sound at the secondary component $f_2$ of the resonance frequency is also increased by the air column resonance.

Especially in the low speed rotation area of the low frequency 100 Hz or below like the air column resonance of the primary component $f_1$ of the exhaust gas sound, there is caused in the passenger room a muffled sound that may give an unpleasant feeling to the driver. The engine rotation speed Ne for the air column resonance frequency of the tertiary component is 6,000 rpm, while the engine rotation speed Ne for the air column resonance frequency of the fourth component is 8,000 rpm. In this way, there is a possibility that the air column resonance frequencies of the multi-stage components are generated. However, the possible noises caused by the air column resonance frequencies of the multi-stage components are not so unpleasant to the driver. Therefore, the multi-stage components larger than the tertiary component are not shown in FIG. 10.

The exhaust gas apparatus according to the present embodiment can reliably suppress the sound pressure (dB) from being increased by the air column resonance that is caused in the conventional tail pipe when the engine rotation speeds Ne are at the low rotation speed of 2000 rpm (primary component $f_1$) and at the medium rotation speed of 4,000 rpm (secondary component $f_2$).

The reason why the increase of the sound pressure level by the air column resonance can be suppressed will be explained hereinafter.

As previously mentioned, the opened end reflection is caused at the opened portion 41*d* against an incident wave incident to the tail pipe 28, and the closed end reflection is caused at the closed portion 41*e* against the incident wave incident to the tail pipe 28. In other words, the opened end reflection and the closed end reflection are respectively caused at the reflection surfaces of the plate 41. More concretely, the reflection waves are distributed to two reflection waves different in phase against the incident waves incident to the tail pipe 28. The distributed reflection waves include a reflection wave by the opened end reflection caused at the opened portion 41*d* of the plate 41 occupying approximately 33% of the total area $S_1$ of the side surface portion 41*b* including the opened portion 41*d* of the plate 41, and an additional reflection wave differing 180 degrees in phase against the incident wave and caused by the closed end reflection at the closed portion 41*e* of the side surface portion 41*b* of the plate 41 occupying approximately 67% of the total area $S_1$ previously mentioned. The reflection waves distributed and caused by the opened end reflection at the opened portion 41*d* and the closed end reflection at the closed portion 41*e* of the side surface portion 41*b* cancel each other. As a consequence, the reflection sounds can be deadened, thereby suppressing the increase of the sound pressure level (dB) caused by the air column resonance.

In this case, in order to obtain the most preferable sound deadening effect of the reflection sound, the reflection rate Rp of the exhaust gas sound incident to the plate 41 is set at 0.5 to have the distribution ratio between the opened end reflection and the closed end reflection become half and half. To have the reflection rate Rp set at 0.5, the opened portion 41*d* is formed to meet $S_2=(1/3)S_1$ in the equation (5) showing the relationship between the opened area $S_2$ ($m^2$) of the opened portion 41*d* and the total area $S_1$($m^2$) of the side surface portion 41*b* including the opened portion 41*d*.

Figure 11:
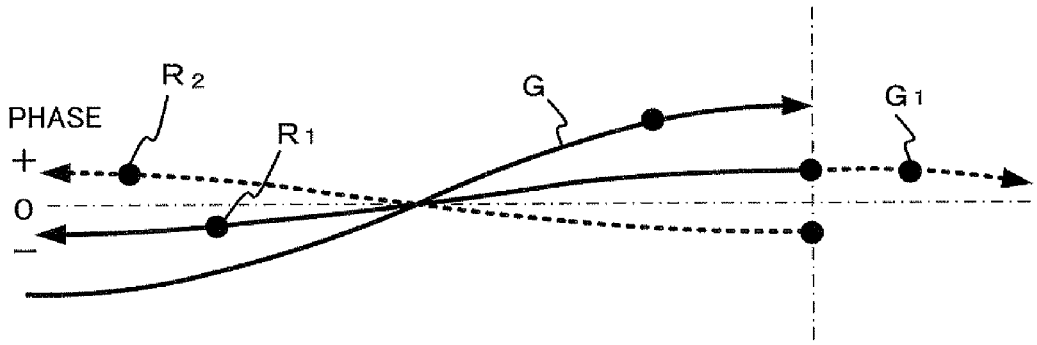
FIG. 11 shows one embodiment of the exhaust gas apparatus of the internal combustion engine according to the present invention, and is a view for explaining a state in which an incident wave "G" is distributed into reflected waves "R1" and "R2" by using a particle velocity distribution schematically showing a particle velocity on a vertical axis and a position of the tail pipe on a horizontal axis.

With reference to FIG. 11, the explanation will be made hereinafter about the opened end reflection, viz., the case that the incident wave G of the exhaust gas sound caused by the exhaust gas pulsation at the time of the operation of the engine 21 is incident into the tail pipe 28 and becomes a fourth incident wave G having a half wave length equal to the pipe length L of the tail pipe 28.

When the frequency of the incident wave G is matched with the air column resonance frequency of the tail pipe 28, part of the incident wave G is invaded into the atmosphere and becomes a transmission wave G1 from the opened portion 41*d* of the plate 41 provided at the downstream opened end 28*b* of the tail pipe 28 as shown in FIG. 11. On the other hand, the above opened end reflection is caused at the opened portion 41*d* of the plate 41, thereby causing the incident wave G to become a reflection wave R1 shown in the solid line and to advance in the direction spaced apart from the plate 41.

The reflection wave R1 is the same in phase as the incident wave G. More specifically, the exhaust gas or the air mass dense or sparse transmitted in the narrow air column formed by the tail pipe 28 is rapidly expanded immediately when the exhaust gas or the air mass reaches a boundary position between the opened portion 41*d* and the large space of the atmosphere. The exhaust gas or the air mass thus expanded becomes sparse in place of dense caused by the inertia thereof. The sparse exhaust gas or the air mass then forms a new wave source that becomes a reflection wave R1 to return in the air column in the direction in which the exhaust gas or the air mass advances immediately before. In this way, the dense exhaust gas or air mass is changed into the sparse exhaust gas or air mass, while the sparse exhaust gas or air mass is changed into dense exhaust gas or air mass. This means that the phase of the incident wave G becomes the phase of the reflection wave R1, thereby causing the reflection wave R1 to become the same in phase as the incident wave G.

In this way, the reflection wave R1 is the same in phase as the incident wave G, and thus the reflection wave R1 is overlapped on the same line with the incident wave G. For convenience of the explanation about the reflection wave R1 and the incident wave G, FIG. 11 shows the reflection wave R1 downwardly displaced with respect to the incident wave G.

On the other hand, the above closed end reflection is caused at the closed portion 41*e* of the plate 41, thereby causing the incident wave G to become a reflection wave R2 shown in the chain line and to advance in the direction spaced apart from the plate 41.

The reflection wave R2 is opposite in phase with respect to the incident wave G, and differs 180 degrees in phase with respect to the reflection wave R1. More specifically, the exhaust gas or air mass dense or sparse transmitted in the narrow air column of the tail pipe 28 collides with the wall surface of the closed portion 41*e* to rebound while the dense exhaust gas or air mass dense remains dense, and the sparse exhaust gas or air mass dense remains sparse, thereby causing the incident wave G to become opposite in phase, so that the incident wave G becomes the same in phase as the reflection wave R2 while the reflection wave R2 becomes opposite in phase to the incident wave G.

In this way, the incident wave G and the reflection wave R2 are opposite in phase to each other. Naturally, the reflection wave R2 is symmetrical with the incident wave G across the horizontal line showing the phase zero. For convenience of the explanation about the reflection waves R1 and R2, FIG. 11 shows the reflection wave R2 downwardly displaced with respect to the reflection wave R1 to have the reflection wave R2 symmetrical with the reflection wave R1 across the horizontal line showing the phase zero.

The reflection wave R1 and the reflection wave R2 are opposite in phase to each other but the same in particle velocity as each other. This means that the reflection wave R1 and the reflection wave R2 function to interfere with and thus cancel each other, thereby causing no air column resonance in the air column of the tail pipe 28. As a consequence, the primary component $f_1$ of the exhaust gas sound caused by the air column resonance can be suppressed, thereby causing the sound pressure level of the exhaust gas sound to drastically be reduced as shown in the solid line in FIG. 10.

The air column resonance of the secondary component $f_2$ is performed based on the primary component $f_1$ fundamental in vibration for this air column resonance. In the air column resonance of the secondary component $f_2$, the reflection wave reflected at the downstream opened end 28*b* of the tail pipe 28 is distributed to a reflection wave R1 caused by the opened portion 41*d* to be the same in phase as the incident wave G and a reflection wave R2 caused by the closed portion 41*e* to be different 180 degrees in phase from the incident wave G, so that the reflection wave R1 and the reflection wave R2 interfere with and cancel each other in a similar manner shown in FIG. 11. As a consequence, as shown in FIG. 10, the secondary component $f_2$, shown by chain line, of the exhaust gas sound caused by the air column resonance is suppressed as shown in solid line, thereby making it possible to drastically reduce the sound pressure level of the exhaust gas sound.

Next, explanation will be made about the incident wave G which is incident to the tail pipe 28 by the pulsation of the exhaust gas at the time of operating the engine 21, the wavelength of the incident wave G basing the wavelength equal to the ¼ length L of the tail pipe 28.

Figure 12:
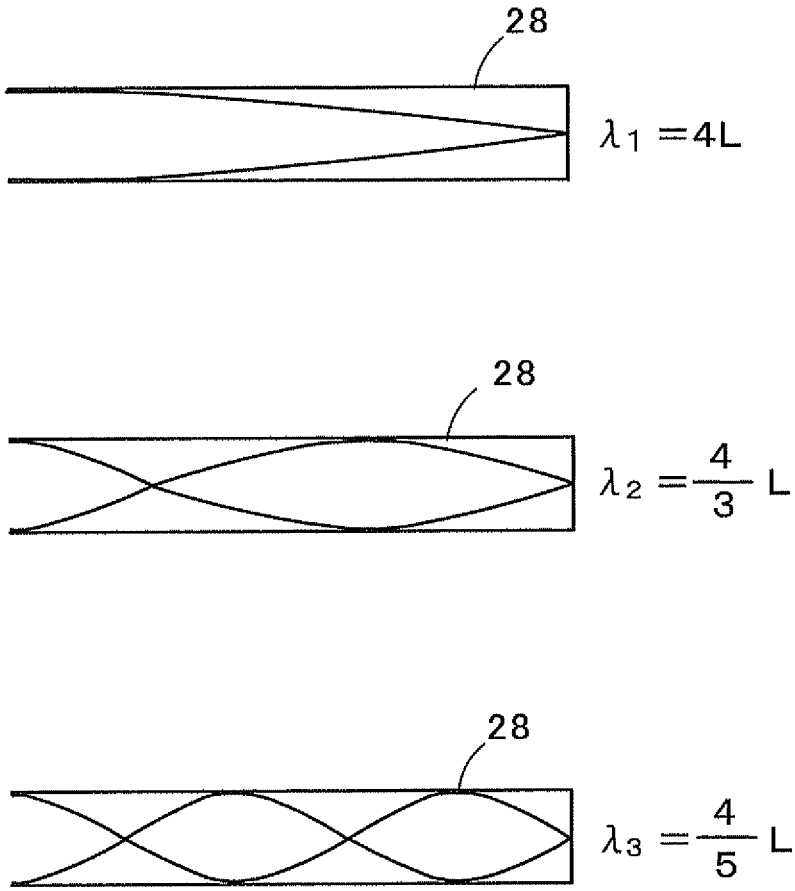
FIG. 12 shows one embodiment of the exhaust gas apparatus of the internal combustion engine according to the present invention, and shows additional views for explaining standing waves of an air column resonance on a particle velocity distribution, the air column resonance being caused by a closed end reflection generated in the tail pipe, and the particle velocity distribution schematically showing a particle velocity on a vertical axis and a position of the tail pipe on a horizontal axis.

As shown in FIG. 9, the opened end reflection is performed to generate the air column resonance resonated at a basic frequency having a half wavelength equal to the pipe length L of the tail pipe 28. The air column resonance thus generated has a wavelength obtained by dividing the basic wavelength by a natural number. In contrast, the closed end reflection is performed as shown in FIG. 12 to generate the air column resonance resonated at a basic frequency having one fourth wavelength equal to the pipe length L of the tail pipe 28. The air column resonance thus generated has a wavelength obtained by dividing the basic wavelength by an uneven number. The incident wave incident in the tail pipe 28 through the opened end of the tail pipe 28 is reflected at a phase different 180 degrees from the incident wave.

More concretely, as shown in FIG. 12, the wavelength $\lambda_1$ of the primary component of the air column resonance having a basic vibration is approximately four times the pipe length L of the tail pipe 28, while the wavelength $\lambda_2$ of the secondary component of the air column resonance is approximately four thirds times the pipe length L of the tail pipe 28. Further, the wavelength $\lambda_3$ of the tertiary component of the air column resonance is approximately four fifths times the pipe length L of the tail pipe 28. Therefore, it is possible to generate a standing wave with the closed end being a node portion of the particle velocity, and with the opened end being an antinode portion of the particle velocity.

The sound pressure distributions of the standing waves of the primary to tertiary components of the exhaust gas sounds have the antinode portions and node portions positioned opposite to those of the particle velocity. This means that the standing wave is generated to have the closed end and the opened end respectively producing the antinode portion and the node portion of the sound pressures.

The increase of the sound pressure level (dB) of the exhaust gas sound caused by the resonance frequency occurs in the case of the wavelength of the incident wave G basing the wavelength equal to the ¼ length L of the tail pipe 28 in the manner the same as the case of the wavelength of the incident wave G basing the wavelength equal to the half length L of the tail pipe 28. More specifically, the sound pressure level (dB) of the exhaust gas sound is increased at the engine rotation speed Ne corresponding to each of the resonance frequencies (Hz) of the primary component $f_1$ and the secondary component $f_2$ in response to the increase of the engine rotation speed Ne (rpm) similarly to the graph shown in FIG. 10.

Here, when the velocity of sound is "c"(m/s), the length of the tail pipe 28 is L(m), and the harmonic degree is "n", the air column resonance frequency fd(Hz) is represented by the following equation (9).

$$fd = \frac{c}{4L}(2n-1) \tag{9}$$

When the velocity of sound "c" is 400 m/s, and the length of the tail pipe 28 is 3.0 m, the primary component $f_1$ and the secondary component $f_2$ of the exhaust gas sound caused by the air column resonance frequency fd(Hz) are 33.3 Hz and 100 Hz, respectively. The sound pressure levels (dB) of the exhaust gas sound are heightened for the primary component $f_1$ and the secondary component $f_2$ caused by the air column resonance corresponding to the rotation speed of the engine 21.

The present embodiment is constructed by an engine 21 with four cylinders, so that in the previous equation (3), N is equal to 4 (N=4). The sound pressure level (dB) of the exhaust gas sound caused by the air column resonance of the primary component $f_1$ is increased at the time of the engine rotation speed Ne being 1,000 rpm, while the sound pressure level (dB) of the exhaust gas sound caused by the air column resonance of the secondary component $f_2$ is also increased at the time of the engine rotation speed Ne being 3,000 rpm.

When the incident wave G with the ¼ wavelength equal to the pipe length L of the tail pipe 28 is incident to the tail pipe 28 with the exhaust gas pulsation at the time of the operation of the engine 21, the resonance frequency of the incident wave G comes to be matched with the air column resonance frequency of the tail pipe 28.

At this time, the reflection wave reflected by the downstream opened end 28*b* of the tail pipe 28 is distributed to the reflection wave R1 of the opened end reflection caused by the opened portion 41*d* the same in phase as the incident wave G, and the reflection wave R2 of the closed end reflection caused by the closed portion 41*e* 180 degrees different in phase from the incident wave G.

At this time, the reflection wave R1 and the reflection wave R2 are opposite in phase to each other, but the same in particle velocity, so that the reflection wave R1 and the reflection wave R2 interferes with each other and cancel each other, thereby resulting in the primary component $f_1$ of the exhaust gas sound caused by the air column resonance being suppressed and thus drastically decreasing the sound pressure level of the exhaust gas sound.

Further, for the air column resonance of the secondary component $f_2$ having the primary component $f_1$ as a fundamental vibration, the reflection wave reflected by the downstream opened end 28*b* of the tail pipe 28 is distributed to the reflection wave R1 of the opened end reflection caused by the opened portion 41*d* the same in phase as the incident wave G, and the reflection wave R2 of the closed end reflection caused by the closed portion 41*e* 180 degrees different in phase from the incident wave G. At this time, the reflection wave R1 and the reflection wave R2 cancel each other, thereby resulting in the secondary component $f_2$ of the exhaust gas sound caused by the air column resonance being suppressed and thus drastically decreasing the sound pressure level of the exhaust gas sound.

(Opened End Correction)

Here, explanation will hereinafter be made about the suitable length of the distance ΔL obtained by the opened end correction.

In the case of the opened end reflection being carried out with no through bore 28*e* as formed in the present embodiment, the apparent length of air column in the air column resonance generated in the tail pipe 28, viz., the length for determining the resonance frequency is known to be Lh somewhat longer than the pipe length ($L-L_2$) from the upstream opened end 28*a* of the tail pipe 28 to the reflection surface portion 41*f* of the plate 41 at the downstream opened end 28*b*. The difference between the pipe length ($L-L_2$) and the apparent length of air column Lh is generated in the opened end reflection strictly due to the fact that the reflections at the both ends are respectively at the position spaced apart by the distance ΔL toward the upstream side from the upstream opened end 28*a*, and at the position spaced apart by the distance ΔL toward the downstream side from the reflection surface portion 41*f* of the plate 41.

The distance ΔL is represented for example by the following equation (10) if the inner diameter of the tail pipe 28 is $D_1$.

$$\Delta L = 0.6\frac{D_1}{2} \tag{10}$$

Therefore, the effective reflection surface in the opened end reflection is positioned toward the downstream side by the distance ΔL from the reflection surface portion 41*f* of the plate 41 without forming the through bore 28*e*. For this reason, the through bore 28*e* is provided at the downstream side by the distance ΔL from the reflection surface portion 41*f* of the plate 41, so that the effective reflection surface in the opened end reflection comes to be positioned at the reflection surface portion 41*f* of the plate 41.

As a consequence, the position of the effective reflection surface in the opened end reflection can precisely be matched with the reflection surface (the reflection surface portion 41*f* of the plate 41) in the closed end reflection. The reflection wave reflected by the opened end reflection and the reflection wave reflected by the closed end reflection at the reflection surface portion 41*f* of the plate 41 become opened end reflections at the upstream opened end 28*a*, and are maintained 180 degrees different in phase.

The length (mm) of the muffler 27 and the outer shape size (mm) of the muffler 27, the numbers of resonance chambers and the expansion chamber, the inner diameters (mm), the thicknesses (mm) and the lengths (mm) of the inlet pipe portion 26A and the tail pipe 28, the thickness (mm) of the plate 41, the diameter $D_1$ of the plate 41, the diameter $D_2$ of the through bore 41*c* of the opened portion 41*d*, the total area $S_1$ of the side surface portion 41*b* of the opened portion 41*d* of the plate 41, the opened area $S_2$, the distances L(mm), $L_1$(mm), $L_2$(mm), and $L_3$(mm) are properly selected based on the data including various designed dimensions of the vehicle, simulation, experiments and experiences to be applied for the exhaust gas apparatus 20 according to the present embodiment.

The following effect can be obtained since the exhaust gas apparatus 20 of the internal combustion engine according to the present embodiment is constructed as stated in the previous description.

As previously mentioned, the exhaust gas apparatus 20 of the internal combustion engine according to the present embodiment is provided with a plate 41 having an opened portion 41*d* and a closed portion 41*e* formed at the downstream opened end 28*b* of the tail pipe 28, thereby making it possible to generate the exhaust gas sound and cause an incident wave in the tail pipe 28. The incident wave of the exhaust gas sound is divided into two reflection waves when the exhaust gas pulsated by the operation of the engine 21 flows into the tail pipe 28 to have the frequency of the exhaust gas sound to be matched with the frequency of the air column resonance of the tail pipe 28. The above two reflection waves include a reflection wave generated by, so called, an opened end reflection caused from the opened portion 41*d* of the plate 41 to have a phase the same as the incident wave of the exhaust gas sound, and a reflection wave generated by, so called, a closed end reflection caused from the closed portion

41*e* to have a phase 180 degrees different from the incident wave. Further, the tail pipe 28 is formed with a through bore 28*e* at its peripheral wall axially inwardly spaced apart from the plate 41 by a predetermined distance $L_2$, so that the reflection wave caused by the opened end reflection and the reflection wave cause by the closed end reflection can be differed 180 degrees, viz., can be made completely opposite to each other under the state that the reflection position of the reflection wave by the opened end reflection is precisely matched with the position of the reflection wave by the closed end reflection, viz., the reflection surface portion 41*f* of the plate 41. As a consequence, it is possible to have both the reflection waves reliably interfere with and cancel each other, thereby making it possible to reduce the sound pressure level to its lowest level. Further, the previously mentioned distance $L_3$ is 0.6 times (L3=0.6D½) the radius (½ of the inner diameter) D½ of the tail pipe 28.

Thus, the exhaust gas apparatus 20 of the internal combustion engine according to the present embodiment can prevent the muffled sound from being generated in the passenger room while the engine is operated at its low rotation speed, and cannot need any sound deadening device in a larger size corresponding to a main muffler which have so far been used, nor a sub-muffler provided in the tail pipe 28. This makes it possible to obtain such an advantageous effect that the exhaust gas apparatus 20 of the internal combustion engine can be simple in construction only with the plate 41 provided in the tail pipe 28 and the through bore 28*e* formed in the tail pipe 28, thereby preventing the exhaust gas apparatus from being increased in weight and in production cost.

Further, the exhaust gas apparatus 20 of the internal combustion engine according to the present embodiment is formed at the tail pipe 28 with the through bore 28*e* extending in the gravity direction, thereby making it possible for the through bore 28*e* to allow the exhaust gas condensed water and the like remaining in the tail pipe 28 to pass therethrough and to be easily discharged to the outside of the tail pipe 28.

Further, the exhaust gas apparatus 20 of the internal combustion engine according to the present embodiment is set to have the opened area $S_2$ of the opened portion 41*d* be ⅓ of the total area $S_1$ including the opened portion 41*d* of the plate 41, so that the reflection rate of the sound wave can be 0.5, thereby causing the reflection wave by the closed end reflection and the reflection wave by the opened end reflection to be generated at the ratio of 1:1. The reflection waves 180 degrees different in phase and generated at the same level interfere with and cancel each other, and thus can enhance the effect of reducing the sound pressure level.

In the exhaust gas apparatus 20 according to the present embodiment, even in the case that the air column resonance is generated with the wavelength having the pipe length L of the tail pipe 28 as a fundamental length, and a length obtained by dividing the fundamental length with a natural number, it is possible to suppress the sound pressure from being increased by the air column resonance of the tail pipe 28, thereby making it possible to obtain such an advantageous effect that the muffled sound can be prevented from being generated in the passenger room while the engine 21 is operated at a low rotation speed (2000 rpm).

Further, even in the case that the air column resonance is generated with the wavelength having a ¼ wavelength equal to the pipe length L of the tail pipe 28 as a fundamental length and a length obtained by dividing the fundamental length with an odd number, it is possible to suppress the sound pressure from being increased by the air column resonance of the tail pipe 28, thereby making it possible to obtain such an advantageous effect that the muffled sound can be prevented from being generated in the passenger room while the engine 21 is operated at a low rotation speed (1,000 rpm).

The above exhaust gas apparatus 20 according to the present embodiment has been explained about the case that the plate 41 is provided only at the downstream opened end 28*b* of the tail pipe 28. However, the exhaust gas apparatus 20 of the internal combustion engine can adopt any construction other than the above construction having the plate 41 provided at the downstream opened end 28*b* of the tail pipe 28.

Figure 13:
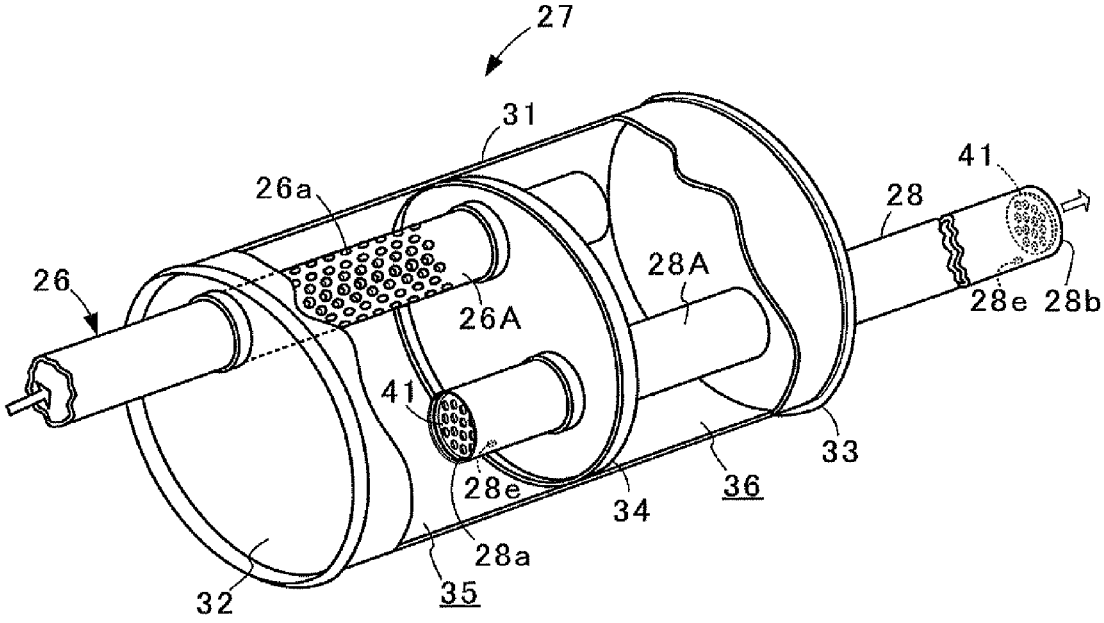
FIG. 13 shows one embodiment of the exhaust gas apparatus of the internal combustion engine according to the present invention, and is a perspective view of a muffler connected to the other tail pipe partly different in construction from the tail pipe shown in FIG. 2 and fragmentarily cross-sectioned.
Figure 14:
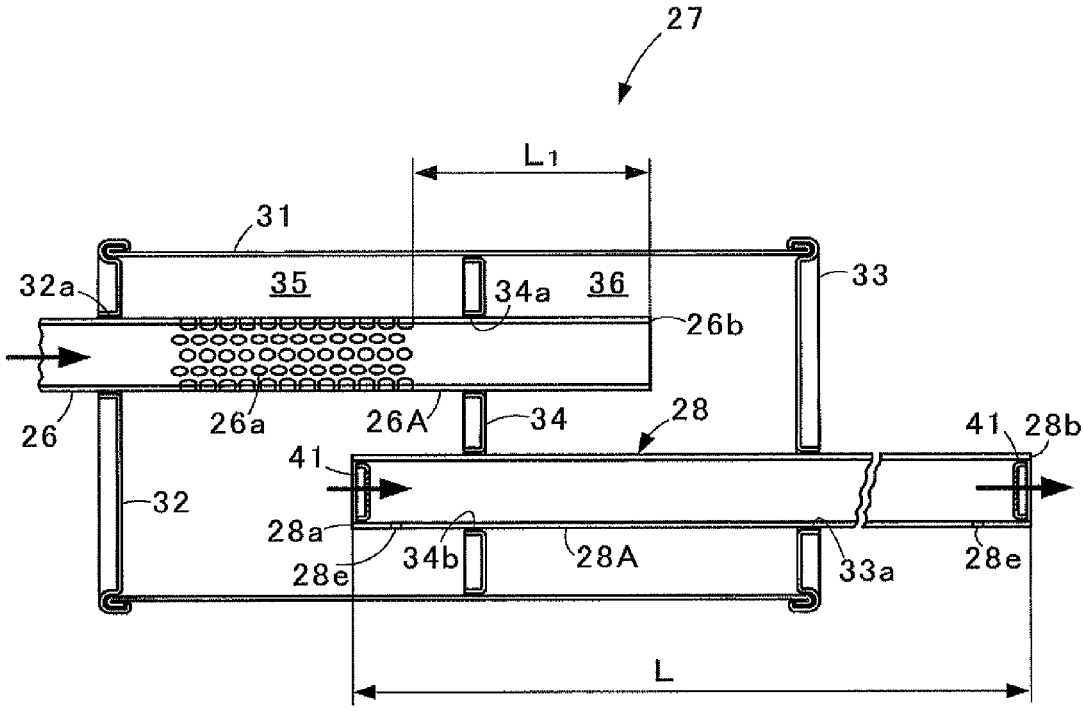
FIG. 14 shows one embodiment of the exhaust gas apparatus of the internal combustion engine according to the present invention, and is a longitudinally cross-sectioned view of the muffler cross-sectioned on a plane passing the center axis of a tail pipe and a center axis of a center pipe shown in FIG. 13, the tail pipe being partly different in construction from the tail pipe shown in FIG. 3.

For example, the exhaust gas apparatus 20 according to the present embodiment may be constructed to have plates 41 provided at both the upstream opened end 28*a* and the downstream opened end 28*b* of the tail pipe 28 as shown in FIGS. 13 and 14. The exhaust gas apparatus 20 may be constructed to have the plate 41 provided only at the upstream opened end 28*a* of the tail pipe 28. The above constructions that the plates 41 are provided at both the upstream opened end 28*a* and the downstream opened end 28*b* of the tail pipe 28, and that the plate 41 is provided only at the upstream opened end 28*a* of the tail pipe 28 can obtain the same effect and advantage as previously mentioned.

Although the above explanation has been made about the case that the opened portion 41*d* of the plate 41 of the exhaust gas apparatus 20 according to the present embodiment is formed with the through bores 41*c* numbering fourteen and each having a diameter $D_2$, the opened portion 41*d* of the plate 41 may be constructed to have any other shape. For example, the number of the through bores 41*c* may include one or plurality other than fourteen. The cross-section of each through bore 41*c* may be formed in any shape other than the circular shape.

Figure 15:
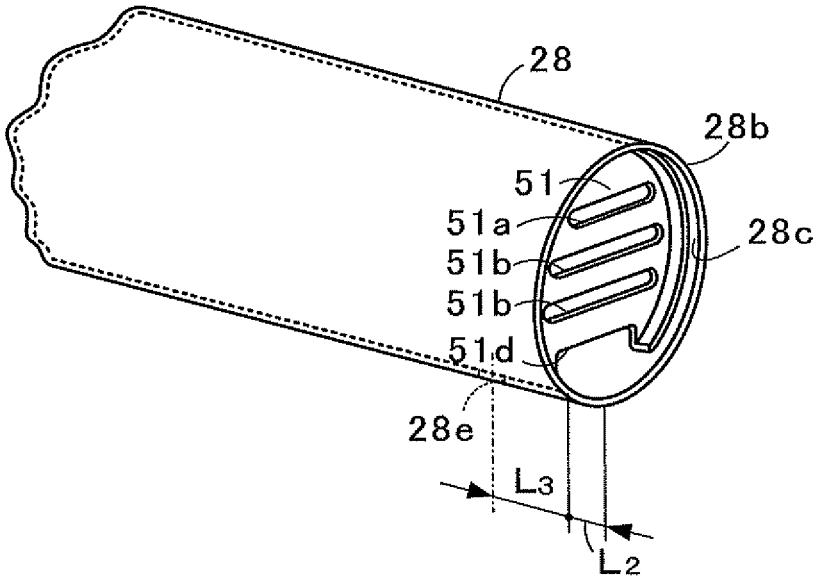
FIG. 15 shows one embodiment of the exhaust gas apparatus of the internal combustion engine according to the present invention, and is a perspective view of a downstream opened end of the tail pipe partly different in construction from the tail pipe shown in FIG. 4.
Figure 16:
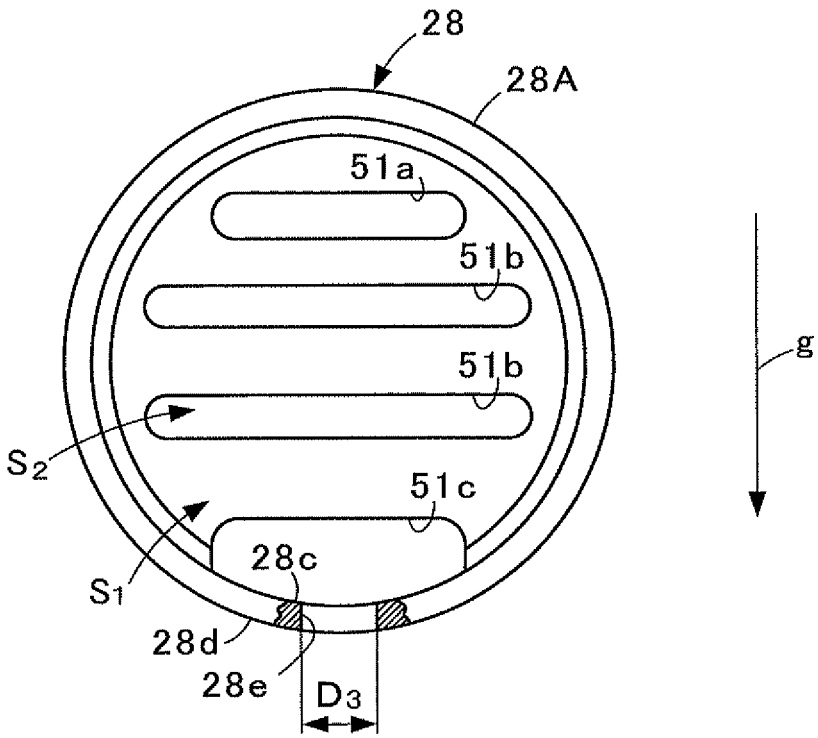
FIG. 16 shows one embodiment of the exhaust gas apparatus of the internal combustion engine according to the present invention, and is a front view of the downstream opened end of the tail pipe partly different in construction from the tail pipe shown in FIG. 5.

For example as shown in FIGS. 15 and 16, the exhaust gas apparatus 20 according to the present embodiment may be constructed to have a plate 51 the same in construction as that of the plate 41 and having an opened portion formed with a slit 51*a* in a roughly rectangular shape, two slits 51*b* larger in length than the slit 51*a*, and a recess 51*c* forming a gap between the plate 51 and the inner peripheral portion 28*c* of the tail pipe 28. In this case, the opened area $S_2$ of the opened portion of the plate 51 is equal to total areas of the slits 51*a*, 51*b* and the recess 51*c*. The slits may be replaced by through bores in an ellipse and other polygonal shapes.

Though the plate 41 of the exhaust gas apparatus 20 according to the present embodiment has been explained about the case that the plate 41 comprises an outer peripheral portion 41*a* projecting toward the one side and having a diameter $D_1$, and a side surface portion 41*b*, the plate may be constructed to have any other shape.

For example, the plate 41 may be constructed by a plate in a disk shape having a predetermined thickness. The above plate comprises an outer peripheral portion having a diameter $D_1$, and a side surface portion positioned to oppose the exhaust direction of the exhaust gas flowing in the tail pipe 28, the outer peripheral portion being held in tight contact with and hermetically sealed with the inner peripheral portion 28*c* of the tail pipe 28.

Further, the tail pipe 28 of the exhaust gas apparatus 20 according to the present embodiment has been explained about the case that only one through bore 28*e* having a circular cross section is formed at a position axially inward of the tail pipe 28 from the side surface portion 41*b* of the plate 41. However, the shape and the number of the through bore 28*e* of the tail pipe 28 in the present embodiment are not limited to the shape and the number of the through bore 28*e* previously mentioned.

Figure 17:
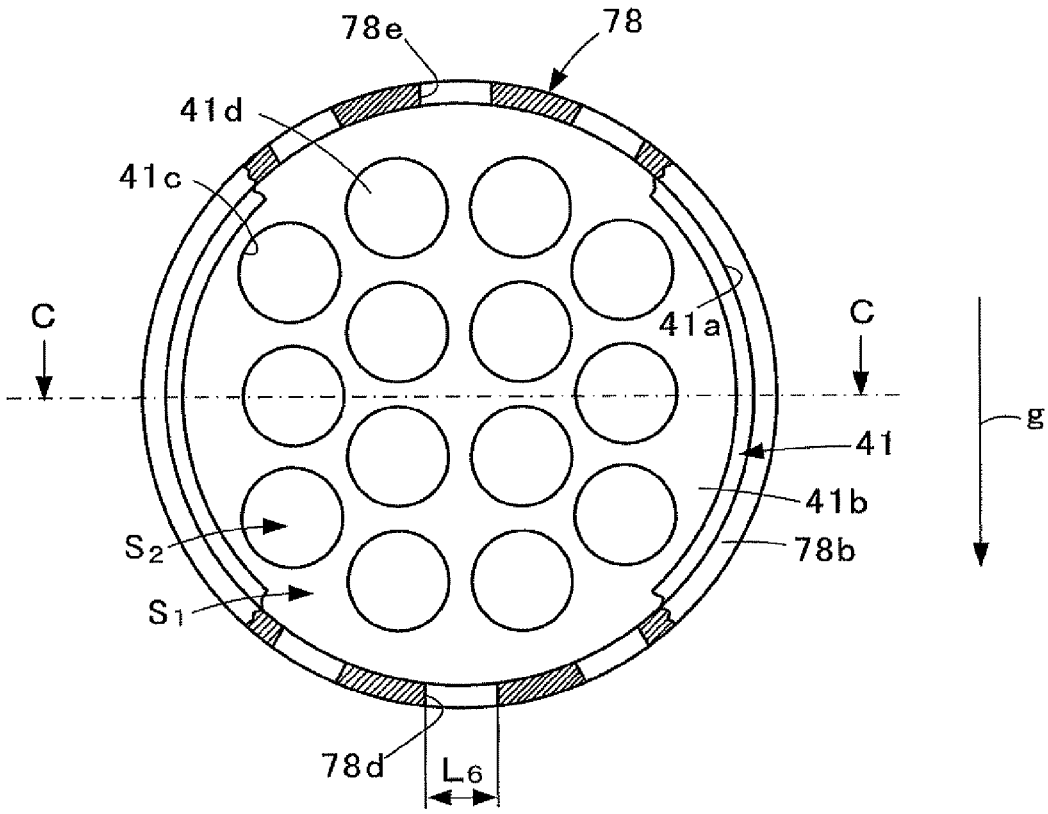
FIG. 17 shows one embodiment of the exhaust gas apparatus of the internal combustion engine according to the present invention, and is a front view of the downstream opened end of the tail pipe partly different in construction from the tail pipe shown in FIG. 5, and showing part of the tail pipe with a cross-section taken on slits formed therein.
Figure 18:
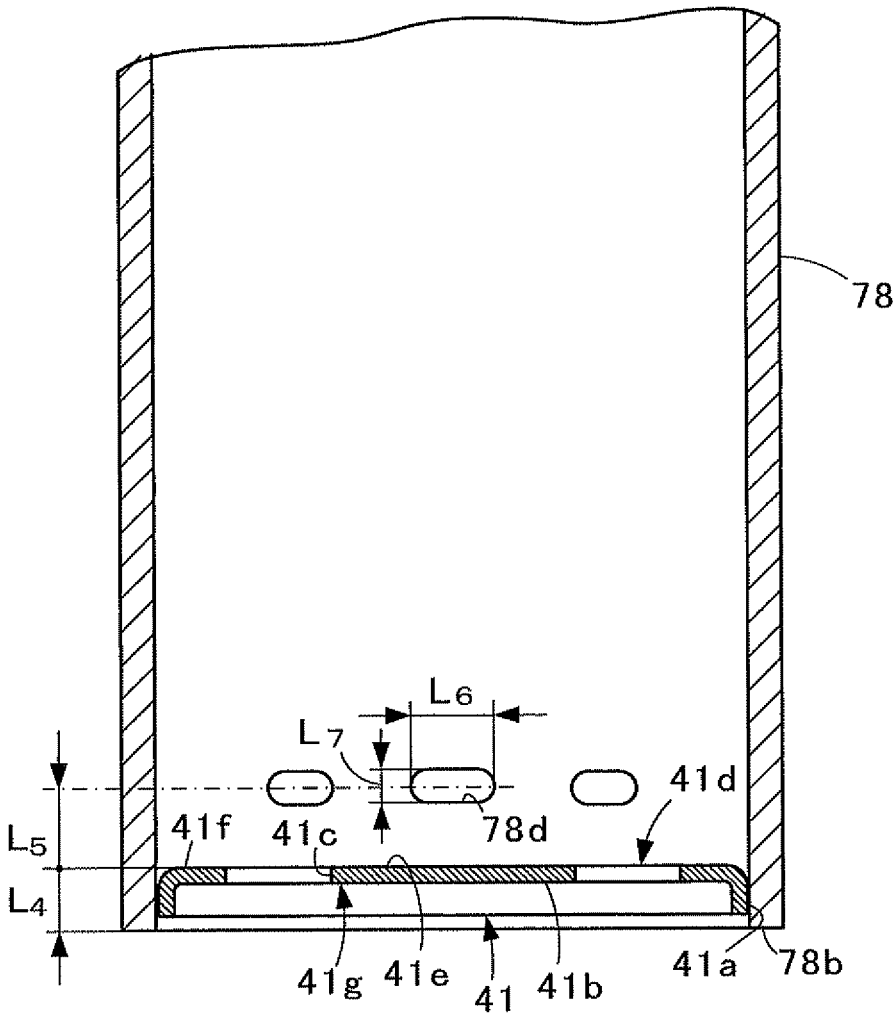
FIG. 18 shows one embodiment of the exhaust gas apparatus of the internal combustion engine according to the present invention, and is a cross-sectional view taken along the line C-C in FIG. 17.
Figure 19:
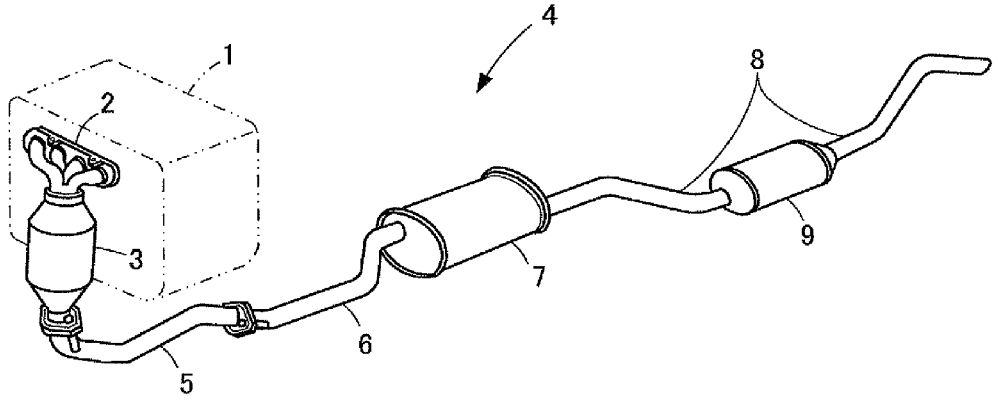
FIG.19 PRIOR ART
FIG. 19 is a perspective view showing the construction of an exhaust gas system provided with a conventional exhaust gas apparatus.
Figure 20:
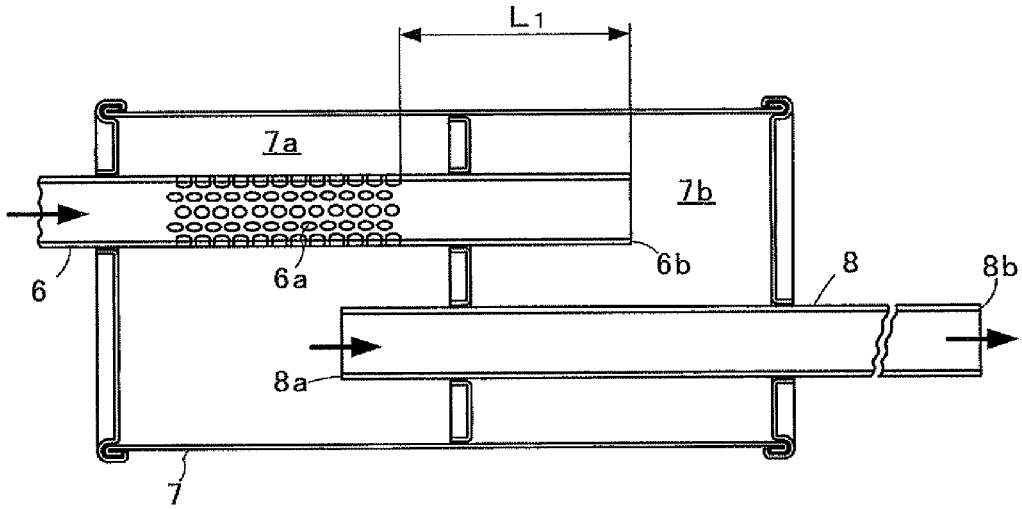
FIG.20 PRIOR ART
FIG. 20 shows the exhaust gas system provided with the conventional exhaust gas apparatus, and is a cross-sectional view of a muffler connected to a tail pipe having opened ends at its both ends.

For example as shown in FIGS. 17 and 18, the tail pipe 78 is constructed to have a plate 41 arranged in such a manner that the side surface portion 41*b* of the plate 41 is positioned at a position spaced apart by the distance $L_4$ axially inward of the tail pipe 78 from the downstream opened end 78*b*. The tail pipe 78 is formed with slits 78*d* numbering three and positioned at a position spaced apart by the distance $L_5$ axially inward of the tail pipe 78 from the side surface portion 41*b* of the plate 41 to pass through the tail pipe 78, each of the slits 78*d* being roughly in a rectangular shape having its length $L_6$ and its width $L_7$. Further, the tail pipe 78 is formed with slits 78*e* numbering three and positioned in opposing relationship with the slits 78*d* to pass through the tail pipe 78.

INDUSTRIAL APPLICABILITY

As has been explained in the above description, the exhaust gas apparatus of the internal combustion engine according to the present invention is such an advantageous in that there is no need for a sub-muffler provided in the tail pipe and for the sound deadening device having a large capacity of resonance chamber at the upstream opened end of the tail pipe, thereby making it possible to suppress the sound pressure level from being increased by the air column resonance of the tail pipe. As a result, the exhaust gas apparatus of the internal combustion engine according to the present invention can reduce its weight and its production cost, and can be useful for all the exhaust gas apparatuses of the internal combustion engine.

REFERENCE SIGNS LIST

20 exhaust gas apparatus
21 engine
22 exhaust gas manifold
24 catalytic converter
25 front pipe
26 center pipe
27 muffler
28, 78 tail pipe
28A outlet pipe portion
28*a* upstream opened end
28*b* downstream opened end
28*c* inner peripheral portion
28*d* outer peripheral portion
35 expansion chamber
36 resonance chamber
41, 51 plate
41*a* outer peripheral portion
41*b* side surface portion
41*c* through bore
41*d* opened portion
41*e* closed portion
41*f* reflection surface portion
$S_1$ total area
$S_2$ opened area

The invention claimed is:

1. An exhaust gas apparatus, comprising an exhaust gas pipe having at one end portion an upstream opened end connected to a sound deadening device positioned at an upstream side in a discharging direction of exhaust gas discharged from an internal combustion engine, and at the other end portion a downstream opened end through which the exhaust gas is discharged to the atmosphere; and a plate formed with an opened portion and a closed portion closing the cross section of the exhaust gas pipe, and provided at the downstream opened end in opposing relationship with the discharging direction of the exhaust gas, wherein the exhaust gas pipe has at a peripheral wall thereof a through bore passing through an outer peripheral portion and an inner peripheral portion of the exhaust gas pipe, the through bore is spaced upstream of the plate in the exhaust gas pipe by a predetermined distance with respect to the inner diameter of the exhaust gas pipe, so that an opened end reflection caused by the downstream opened end is positioned at the plate, and the through bore is empty and open to an outside of the exhaust gas pipe.

2. An exhaust gas apparatus as set forth in claim 1, in which the through bore is formed at a lower portion of the exhaust gas pipe to extend in the gravity direction.

3. An exhaust gas apparatus as set forth in claim 1, in which the opened portion has an opened area set to one third the total area of the plate including the closed portion and the opened portion.

4. An exhaust gas apparatus as set forth in claim 1, in which the through bore is formed at a lower portion of the exhaust gas pipe to extend in the gravity direction, and the opened portion has an opened area set to one third the total area of the plate including the closed portion and the opened portion.

* * * * *